US009302314B2

(12) United States Patent
Berring et al.

(10) Patent No.: US 9,302,314 B2
(45) Date of Patent: Apr. 5, 2016

(54) METHOD AND APPARATUS FOR TRANSLATING CAN BLANKS

(71) Applicant: Standard Engineering Group, Inc., North Canton, OH (US)

(72) Inventors: Jeffery J. Berring, Canton, OH (US); Barry A. Lippert, Canton, OH (US); Ronald S. Schlemmer, Canton, OH (US); William J. Simmons, Canton, OH (US); Don P. Wharton, North Canton, OH (US)

(73) Assignee: Standard Engineering Group, Inc., North Canton, OH (US)

( * ) Notice: Subject to any disclaimer, the term of this patent is extended or adjusted under 35 U.S.C. 154(b) by 230 days.

(21) Appl. No.: 13/959,826

(22) Filed: Aug. 6, 2013

(65) Prior Publication Data

US 2014/0311206 A1 Oct. 23, 2014

Related U.S. Application Data

(60) Provisional application No. 61/813,304, filed on Apr. 18, 2013.

(51) Int. Cl.

| | |
|---|---|
| ***B21D 45/04*** | (2006.01) |
| ***B21D 22/28*** | (2006.01) |
| ***B21D 35/00*** | (2006.01) |
| ***B21D 43/05*** | (2006.01) |

(52) U.S. Cl.

CPC ..... *B21D 45/04* (2013.01); *B21D 22/28* (2013.01); *B21D 35/003* (2013.01); *B21D 43/055* (2013.01)

(58) Field of Classification Search

CPC ..... B21D 24/10; B21D 22/28; B21D 43/055; B21D 45/04; B21D 35/003

See application file for complete search history.

(56) References Cited

U.S. PATENT DOCUMENTS 2,301,682 A 11/1942 Candee et al.
4,428,221 A * 1/1984 Owens ..... 72/405.12

* cited by examiner

*Primary Examiner* — Teresa M Ekiert
(74) *Attorney, Agent, or Firm* — Sand & Sebolt

(57) ABSTRACT

A redraw press with an improved can blank transfer mechanism is provided which allows for a substantial increase in the operating speed of the press. Servomotors are used to accurately control positioning and rates of movement of the can blanks as they move downstream through the press.

24 Claims, 17 Drawing Sheets

32R
40D
126
22,30
130
128
8
100
130
136
130
132
6
100
98
130
126
40C
32L
132
134
144
98
136
X4
14
7
174R
64
136
136
138
68
64
174L
174R
64
6
68
70D
47
58
174L
58,60
70D
174L
174R
70D
74
69
74
69
43,45
110R
106D
7
E
110L
5
70U
122D
56
110L
110R
56
124
70U
174R
150
174L
122C
D2
54
50,
52
120L
43,
45
5
122B
106U
D1
48
106U
122B
122A
120R
120L
120R
120L
120R
44,46
122A
74
69
71
102
4
71
71
69
74
68
92A
92A
92B
71
92A
92A
68
92B
62C
90
62B
92B
62A
92B
40B
28R
82
85
100
98
86
88
85
X1
4
85
100
98
84
85
82
28L
40A 6
1

METHOD AND APPARATUS FOR TRANSLATING CAN BLANKS

CROSS REFERENCE TO RELATED APPLICATION

This application claims priority from U.S. Provisional Application Ser. No. 61/813,304, filed Apr. 18, 2013; the disclosure of which is incorporated herein by reference.

BACKGROUND

1. Technical Field

The invention is related generally to can making machinery and more particularly to a transfer apparatus and method for translating or moving can blanks through a redraw press.

2. Background Information

Redraw presses generally include a die having a plurality of can receiving cavities which may sequentially have smaller diameters in the downstream direction. Pistons or punches which correspond to each of these cavities and/or may be aligned therewith in order to move into and out of the cavities to press a can blank within the cavity in order to sequentially transform the can blank into smaller and smaller diameters. A transfer mechanism is used to move the can blanks downstream into respective positions aligned with the respective cavities so that the can blanks are properly aligned for the punches to force the can blank into the corresponding cavity.

Various problems are known in the art which may be partly related to the type of metal or alloy used to make the can blanks or containers, the container strength, container height, container diameter and the speed with which the blanks or containers or cans move through the redraw press. For instance, the transfer mechanism must be set to grasp a container of a given diameter in order to properly carry or transfer it from one position to another. In addition, a change in the metal alloy or the thickness of the container wall changes the strength of the container such that a container of a given strength may need to be handled differently than another container of a different strength. For instance, a container of a lesser strength may need to be held more gingerly in order to prevent damage to the container. Such a container may also need to be held for a longer period of time just prior to downstroke of the punch in order to make sure that the container or blank is properly aligned so that the punch will not damage the blank or the canning machine. The desire within the industry to make containers or cans of a lighter and lighter weight naturally increases the difficulty with respect to handling containers having thinner walls and/or made from weaker alloys, such as aluminum alloys.

Some transfer mechanisms use magnets for steel containers in order to hold the containers in the proper location. However, the use of a magnet to help position a container in this manner will also hinder the next movement of the same container. Furthermore, magnets of course will not assist with the positioning of aluminum containers or other non-magnetic metals.

The transfer mechanism of redraw presses typically utilizes a pair of can gripping members which move inwardly toward one another and outwardly away from one another whereby their inward movement allows them to grasp or grip a can blank or container and their outward movement allows them to release the container. Thus, these gripping members will move inwardly in an axial direction to grasp a given can blank or container, and then move longitudinally downstream while continuing to grasp or hold the container in order to move the container to the next position or station for subsequent punching by a smaller diameter punch. The standard mechanical transfer mechanism utilizes various mechanical cams and linkages which are limited in various features. As will be readily understood, can manufacturers wish to produce their cans as quickly as possible, and thus have a tendency to increase the speed in which the stamping operation proceeds. However, the standard transfer mechanism cannot operate at certain higher speeds without causing expensive damage to the machinery, especially the die and piston or punch. More particularly, as the operational speed of the machine is increased, the standard transfer mechanism tends to throw a container or can blank generally into position in a sloppy manner as opposed to controlling it and holding it in the desired position. Due to the configuration of the standard transfer mechanism, the various moving parts thereof all move at interrelated ratios. As a result, when the operation reaches a certain speed, the gripping members either throw the can blank toward the desired position in an inaccurate manner or are unable to hold the blank in the desired position long enough to ensure that the blank is accurately placed prior to its being punched. The faster the operation, the longer the time period or duration that the can blank or container remains free of control or restraint. Thus, there is a need in the art to overcome these and various other problems.

SUMMARY

In one aspect, the invention may provide a redraw press comprising: a die defining a first can blank-receiving cavity; a first punch which is movable between a first punch extended position inside the first cavity and a first punch retracted position outside the first cavity; a first pair of can blank-gripping first fingers, wherein the first pair is movable longitudinally back and forth in upstream and downstream directions, wherein the first fingers are movable axially inwardly toward one another and the first cavity, and wherein the first fingers are movable axially outwardly away from one another and the first cavity; an ejector system comprising an ejector which is movable within the first cavity and has an ejecting position and a non-ejecting position, wherein the ejector is adapted to eject a can blank from the first cavity upon movement from the non-ejecting position to the ejecting position; and a first servomotor which is one of (a) operatively connected to the first fingers and configured to drive movement of the first fingers and (b) operatively connected to the ejector and configured to drive movement of the ejector between the ejecting and non-ejecting positions.

In another aspect, the invention may provide a redraw press comprising: a die defining a first can blank-receiving cavity; a first punch which is movable between a first punch extended position inside the first cavity and a first punch retracted position outside the first cavity; a first pair of can blank-gripping first fingers, wherein the first pair is movable longitudinally back and forth in upstream and downstream directions, wherein the first fingers are movable axially inwardly toward one another and the first cavity, and wherein the first fingers are movable axially outwardly away from one another and the first cavity; and a drive train comprising a crank, a longitudinal slider and an axial slider which carries one of the first fingers; wherein longitudinal movement of the longitudinal slider is translated into axial movement of the axial slider by rotation of the crank.

In another aspect, the invention may provide a method comprising the steps of: providing a redraw press having first and second die cavities each adapted to receive can blanks, first and second punches respectively movable into and out of the first and second cavities, a pair of can blank-gripping fingers capable of moving a can blank from a first station adjacent the first cavity to a second station adjacent the second cavity, an ejector which is movable within and capable of ejecting can blanks from one of the first and second cavities, and a servomotor; and operating the servomotor to one of (a) move the fingers axially toward one another at a first axial rate over a first axial distance and at a second different axial rate over a second axial distance, (b) move the fingers longitudinally downstream at a first longitudinal rate over a first longitudinal distance and at a second different longitudinal rate over a second longitudinal distance, and (c) move the ejector in an ejecting direction at a first ejecting rate over a first ejecting distance and at a second different ejecting rate over a second ejecting distance.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

Similar numbers refer to similar parts throughout the drawings.

DETAILED DESCRIPTION

Figure 1:
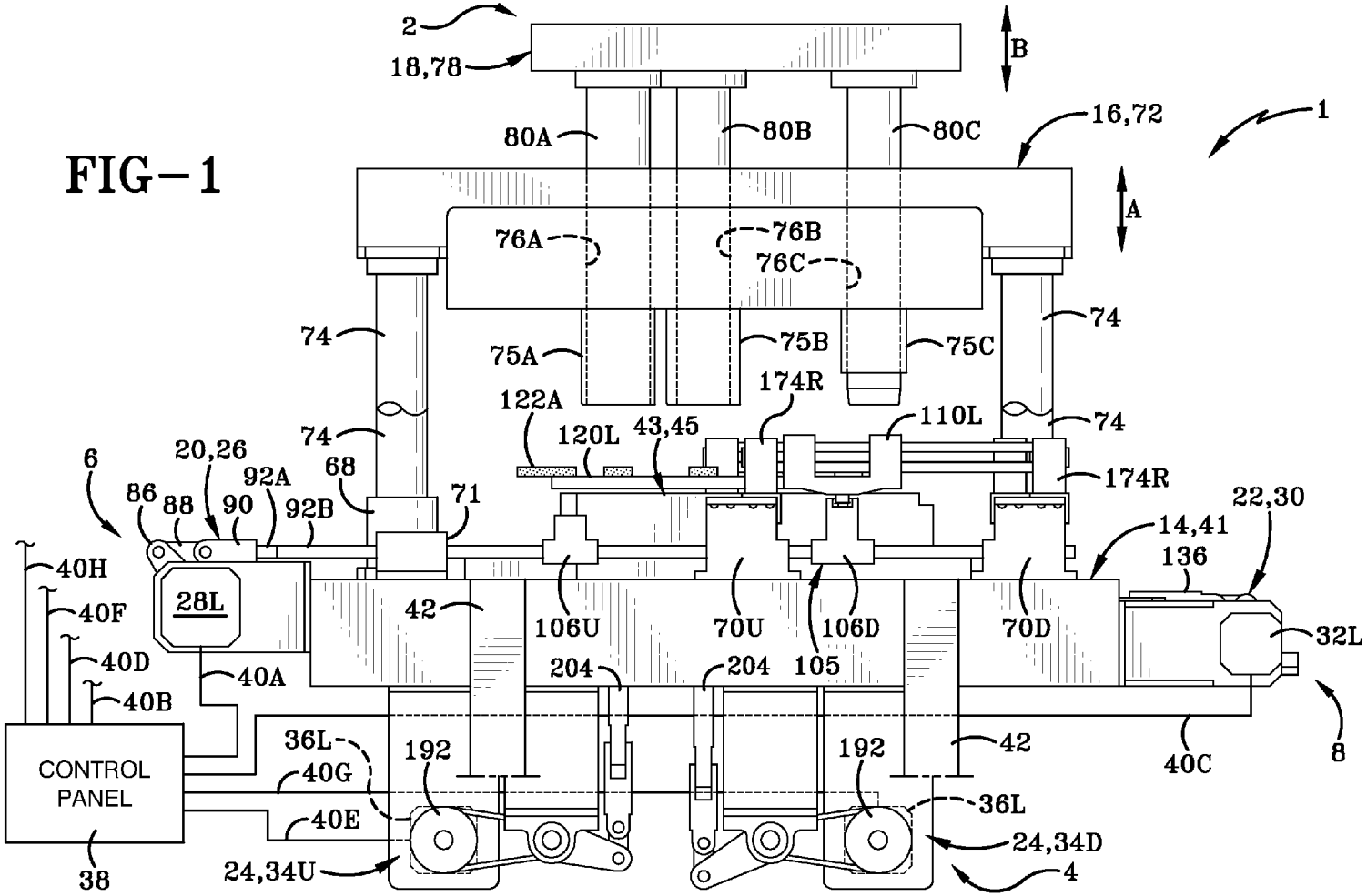
FIG. 1 is a left side elevation view of a sample embodiment of the can forming machine.
Figure 2:
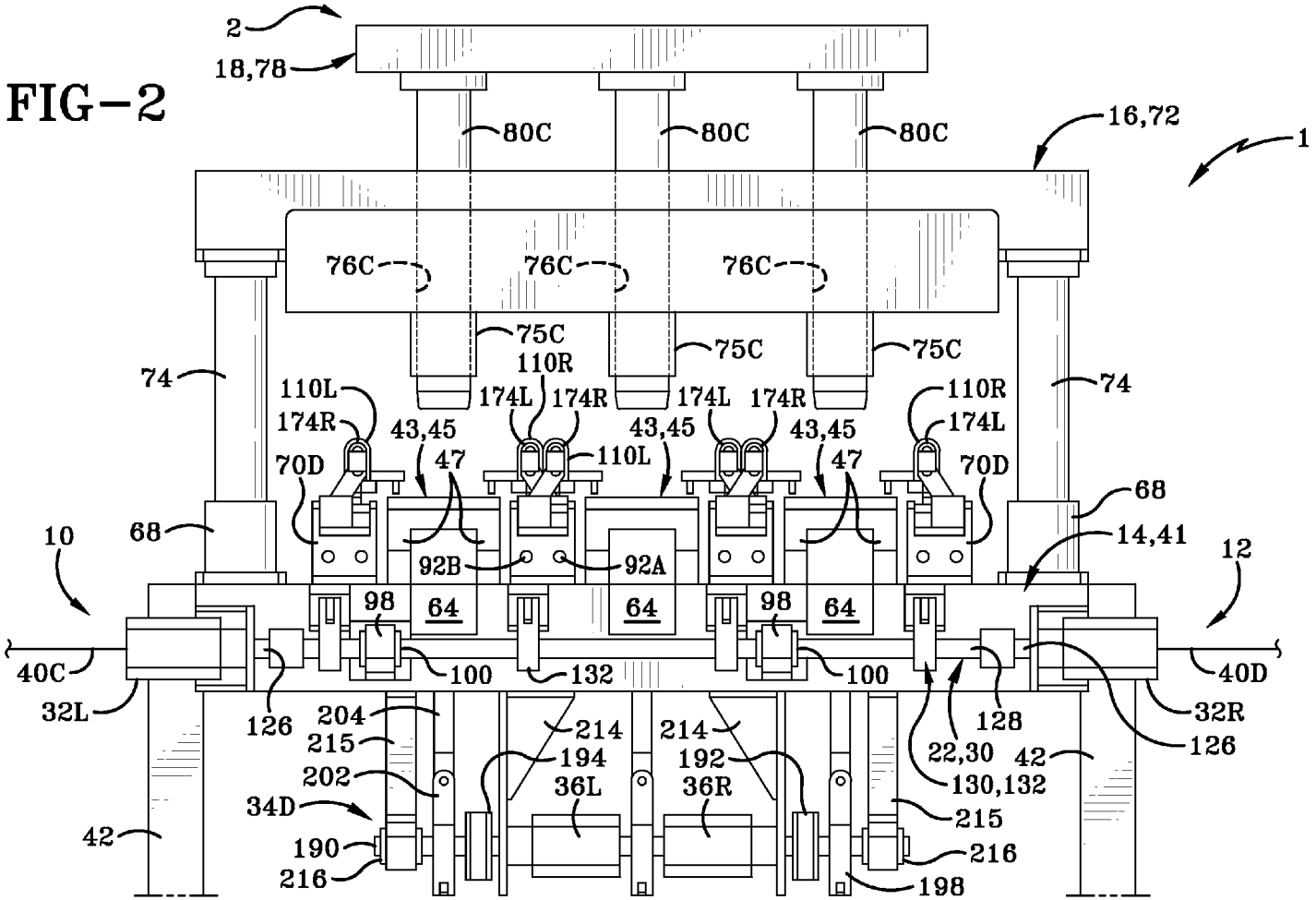
FIG. 2 is a downstream end elevation view of the sample embodiment looking in the upstream direction.
Figure 3:
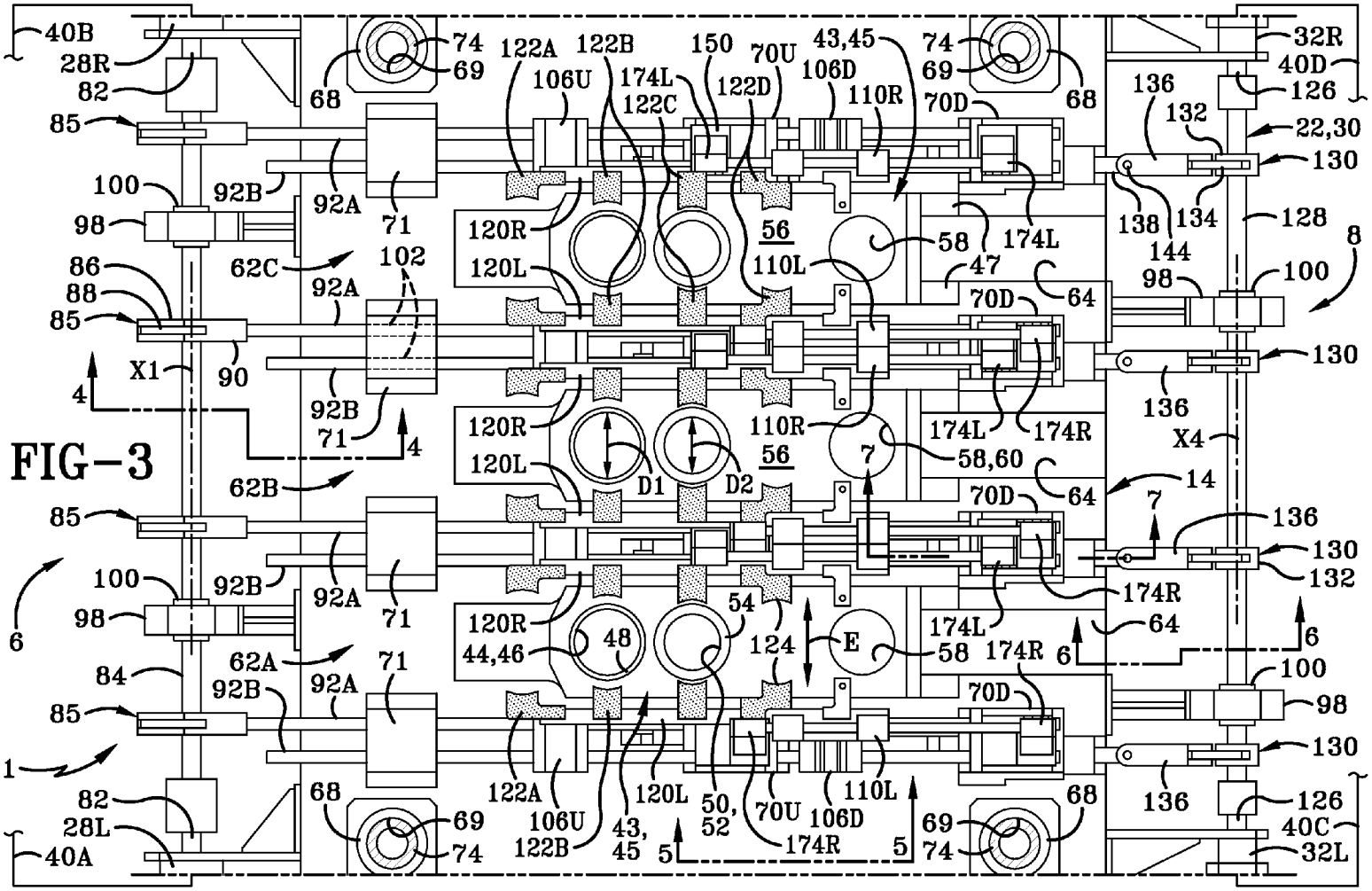
FIG. 3 is a top plan view of the die and various components mounted thereon wherein the left and right sides of the die are not shown.

A sample embodiment of the redraw press or machine is shown generally at 1 in FIGS. 1-3. Machine 1 has a top 2, a bottom 4, upstream and downstream ends 6 and 8 defining therebetween a longitudinal direction, and left and right sides 10 and 12 (FIG. 2) defining therebetween an axial direction. Machine 1 includes a rigid frame including a rigid die 14, a press which includes a rigid press lower section 16 which is mounted on and movable upwardly and downwardly back and forth (Arrow A) relative to the frame and die 14, and a press upper section 18 which is mounted on and movable upwardly and downwardly back and forth (Arrow B in FIG. 1) relative to lower section 16 and die 14. Any press drive assembly (not shown) known in the art may be used to drive the up and down movement of press sections 16 and 18. Machine 1 further includes a longitudinal drive assembly 20, an axial drive assembly 22, and an ejector drive assembly 24. Longitudinal drive assembly 20 includes a longitudinal drive train 26 and left and right longitudinal servomotors 28L and 28R which are operatively connected to drive train 26 for driving movement thereof. Axial drive assembly 22 includes an axial drive train 30 and left and right axial servomotors 32L and 32R which are operatively connected to drive train 30 for driving movement thereof. Ejector drive assembly 24 includes upstream and downstream ejector drive mechanisms which respectively include upstream and downstream ejector drive trains 34U and 34D, and left and right ejector servomotors 36L and 36R. Machine 1 further includes a control panel 38 which is in electrical or other communication respectively with servomotors 28, 32 and 36, such as by electrical wires 40A-40H. Control panel 38 is in communication with a computer program of press 1 which is configured to control the movement of each of the servomotors and thus movement of each of the drive trains. In the sample embodiment, the computer program may be a programmable computer program which is in electrical or other communication with various types of operator input devices of control panel 38 whereby an operator of machine 1 may create and input a specific set of commands on the computer program for controlling the movement of the servomotors and drive trains in a specific manner as discussed in greater detail further below.

The frame of machine 1 may include rigid legs 42 which are rigidly secured to and extend downwardly from die 14 such that the bottom of legs 42 engage and are usually rigidly secured to a floor (not shown). Die 14 may include a rigid die base 41 and a plurality of die members 43 which are rigidly secured to and extend upwardly from die base 41. Each die member 43 in the exemplary embodiment has a generally inverted U-shaped configuration as viewed from upstream or downstream (FIG. 2), and includes a generally horizontal die wall 45 and a pair of axially spaced legs 47 rigidly secured to die wall 45 and extending downwardly therefrom. Die base 41 is usually formed of a heavy rigid material such as a metal, and is usually in the form of a heavy, metal block. Die members 43 are rigid and also typically formed of metal. Die members 43 may define a various number of cup-receiving or can blank-receiving cavities which are configured to receive therein metal cups or metal can blanks which are to be formed into cans at least in part by machine 1. More particularly, the metal cups or can blanks are redrawn using punches (discussed further below) into metal cups or can blanks having a smaller diameter, a greater depth and thinner walls, in a manner which is generally known in the art. Die 14 may include several lanes of die cavities each including a first or upstream cup-receiving or can blank-receiving cavity 44 which is a through hole extending from the top of die wall 45 to the bottom of die wall 45 and is defined by a circular annular inner surface or perimeter 46. A clamping recess 48 may be formed in die wall 45 concentric with cavity 44 extending radially outwardly therefrom along the top of die wall 45. A second can-receiving or can blank-receiving cavity 50 may also be formed in each of the lanes and defined by a circular annular surface or perimeter 52. Die 14 may further include a clamping recess 54 concentric with cavity 50 along the upper or top surface of die wall 45 and extending radially outwardly from the upper portion of cavity 50. Inner perimeter 46 defines an inner diameter D1 of cavity 44, while inner perimeter 52 defines an inner diameter D2 of cavity 50 which is somewhat smaller than diameter D1. Each lane may further include a resting station 56 which is shown by a circle in FIG. 3 although it may simply be a flat top surface of die wall 45 which is downstream of cavity 50. Die 14 may further define a cup-receiving or can blank-receiving trim cavity 58 defined by a circular annular inner surface or perimeter 60 wherein cavity 58 is downstream of resting station 56.

Three lanes 62A-C each including a cavity 44, cavity 50, station 56 and cavity 58 are shown in FIG. 3 wherein lane 62A may be considered a left lane, lane 62B may be considered a middle lane to the right of lane 62A, and lane 62C may be considered a right lane to the right of middle lane 62B. In many cases, more lanes such as one of lanes 62 are formed in a given die although this will vary from case to case. Each lane 62 may further include a discharge trough 64 which is formed in die base 41 and extends downwardly from the upper surface thereof so that a portion of each trough 64 is directly below trim cavity 58 and extends therefrom to the downstream end of die base 41. A discharge mechanism or conveyor system (not shown) may be disposed at least partially within trough 64. A pair of ejector passages 66 (FIGS. 7, 13) is formed in die base 41. Each of ejector passages 66 is a through passage which extends from the bottom of the die base 41 upwardly therefrom to communicate with a respective one of cavities 44 and 50. Where die members define additional drawing cavities such as 44 and 50, additional ejector passages 66 will be formed in communication therewith as well.

The rigid frame of machine 1 may further include a plurality of rigid cylinders or sleeves 68 typically made of metal and in the sample embodiment including four sleeves 68 generally adjacent the corners of die base 41. Each of sleeves 68 is rigidly secured to and extends upwardly from the top of die base 41. Each sleeve 68 defines a piston-receiving passage 69 which is substantially cylindrical and vertical in the sample embodiment. To the right and left of each lane 62, the frame may also include upstream and downstream mounting blocks or housings 70U and 70D which are rigidly secured to and extend upwardly from the top of die base 41. Thus, there are mounting blocks 70U and D to the left of lane 62A, between lanes 62A and 62B, between lanes 62B and 62C, and to the right of lane 62C. The frame of machine 1 also includes a plurality of guide blocks 71 which are rigidly secured to and extend upwardly from the top of die base 41. In the sample embodiment, four blocks 71 are shown with each adjacent pair of blocks 71 being disposed on the left and right sides of a given lane 62. One of blocks 71 is disposed between lane 62A and 62B, while another of blocks 71 is disposed between lanes 62B and 62C. Blocks 71 are generally adjacent the upstream end of die base 71 and are axially spaced from one another.

Press lower section 16 includes a lower press section main block or plate 72 with four pistons 74 rigidly secured to and extending downwardly therefrom adjacent the respective corners of plate 72. Pistons 74 are respectively received within slide passages 69 of sleeves 68 so that pistons 74 are slidable up and down therein. In the sample embodiment, there are three sets of punch assemblies which are respectively associated with lanes 62A-C. Each set includes punch cylinders or clamping members 75A-C such that cylinder 75A corresponds to cavity 44 and recess 48, cylinder 75B corresponds to cavity 50 and recess 54, and cylinder 75C corresponds to cavity 58. Each of cylinders 75 is rigidly secured to and extends downwardly from the bottom of main plate 72. Main plate 72 and the respective cylinders 75A-C respectively define vertical cylindrical passages 76A-C extending from the top of plate 72 to the bottom of the given cylinder 75.

Press upper section 18 includes an upper press section main block or plate 78 and three sets of punches 80A-80C which are respectively associated with cylinders 75A-75C and are slidably received respectively in passages 76A-76C so that each punch 80 is vertically slidable up and down within the given passage 76. Each punch 80A is slidably receivable within one of cavities 44, while each punch 80B is slidably receivable within one of cavities 50, and each punch 80C is slidably receivable within one of cavities 58. More particularly, the lower ends of punches 80 are movable downwardly into the respective cavities 44, 50 and 58 to an extended or lowered position (FIG. 16) in the cavities and removable from these cavities and movable upwardly to be spaced upwardly above them in a retracted or raised position (FIGS. 1, 2, 13) external to and above the cavities.

Figure 4:
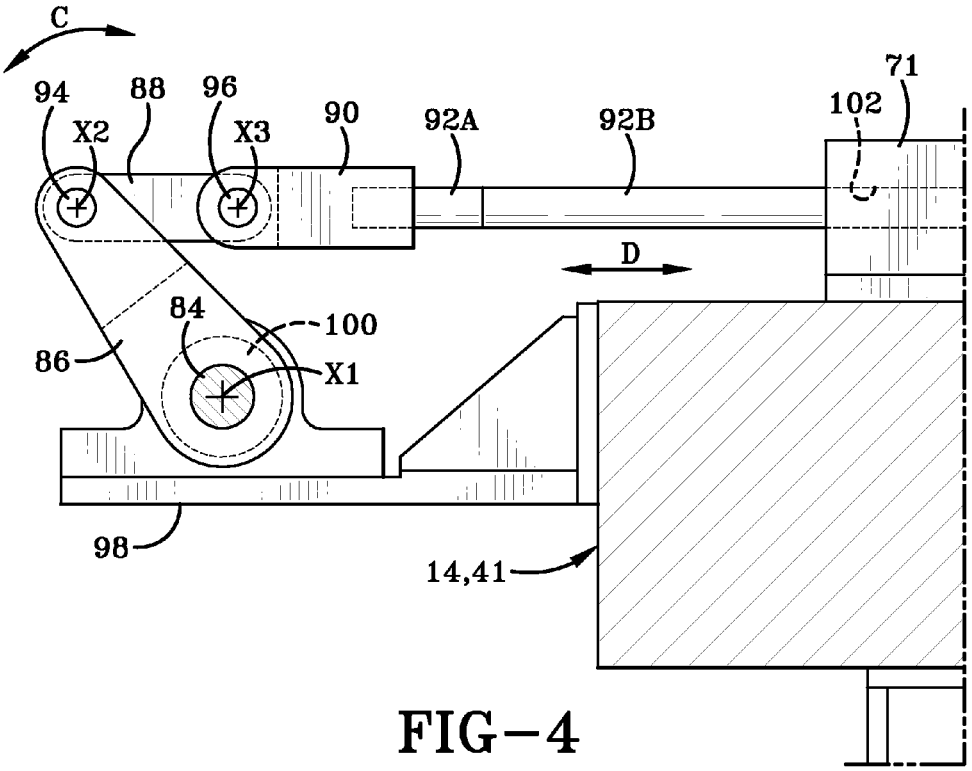
FIG. 4 is an enlarged sectional view taken on line 4-4 of FIG. 3 showing portions of the longitudinal movement drive train.

With primary references to FIGS. 1 and 3-5, longitudinal movement drive assembly 20 is further described. As previously noted, assembly 20 includes longitudinal servomotors 28L and 28R. Each of servomotors 28 includes a rotational output, the rotation of which drives the movement of longitudinal drive train 26. As shown in FIGS. 3 and 4, drive train 26 includes a straight horizontal axially elongated drive shaft 84 which is rotatable back and forth by output 82 about a horizontal axis X1 which extends in the axial direction upstream of the upstream end of die base 41 and passes through shaft 84 and output 82. Drive train 26 includes several drive train subassemblies 85 each of which is driven by the rotation of drive shaft 84. Each subassembly 85 of drive train 26 includes a pivot arm 86, a pivot link 88, a bar mount or rod mount 90, and a pair of side-by-side straight horizontal parallel slide bars or slide rods 92A and 92B which are longitudinally elongated and run perpendicular to drive shaft 84. Pivot arm 86 adjacent a lower end thereof is rigidly secured to drive shaft 84 and thereby rotates (Arrow C in FIG. 4) with drive shaft 84 about axis X1. An opposed upper end of pivot arm 86 is pivotally connected to an upstream end of pivot link 88 at a pivot 94 such that pivot arm 86 and pivot link 88 are pivotable relative to one another about an axis X2 which is parallel to and offset from axis X1. A downstream end of pivot link 88 is pivotally connected to an upstream end of rod mount 90 at another pivot 96 such that link 88 and rod mount 90 are pivotable about a third axis X3 which is parallel to and offset from axes X1 and X2. A downstream end of bar mount or rod mount 90 is rigidly secured to slide bar 92A, which is horizontally slidable back and forth in a linear fashion in the longitudinal direction (Arrow D in FIG. 4) in response to the back and forth pivotal movement of a pivot arm 86 about axis X1.

A pair of bearing mounts 98 (FIG. 3) which are axially spaced from one another are each rigidly secured to the upstream end of die base 41 and extend upstream therefrom. A bearing 100 is mounted on or carried by each bearing mount 98 and receives therethrough drive shaft 84 whereby drive shaft 84 is rotatably mounted on die base 41 via bearing mount 98 to rotate about axis X1. Slide rods 92A and 92B are slidably received within respective slide passages 102 formed in a given guide block 71. Slide rods 92A and 92B are likewise respectively slidably received in a pair of slide passages 104 formed in mounting blocks 70, although only one passage 104 is shown in block 70U in FIG. 5.

Figure 5:
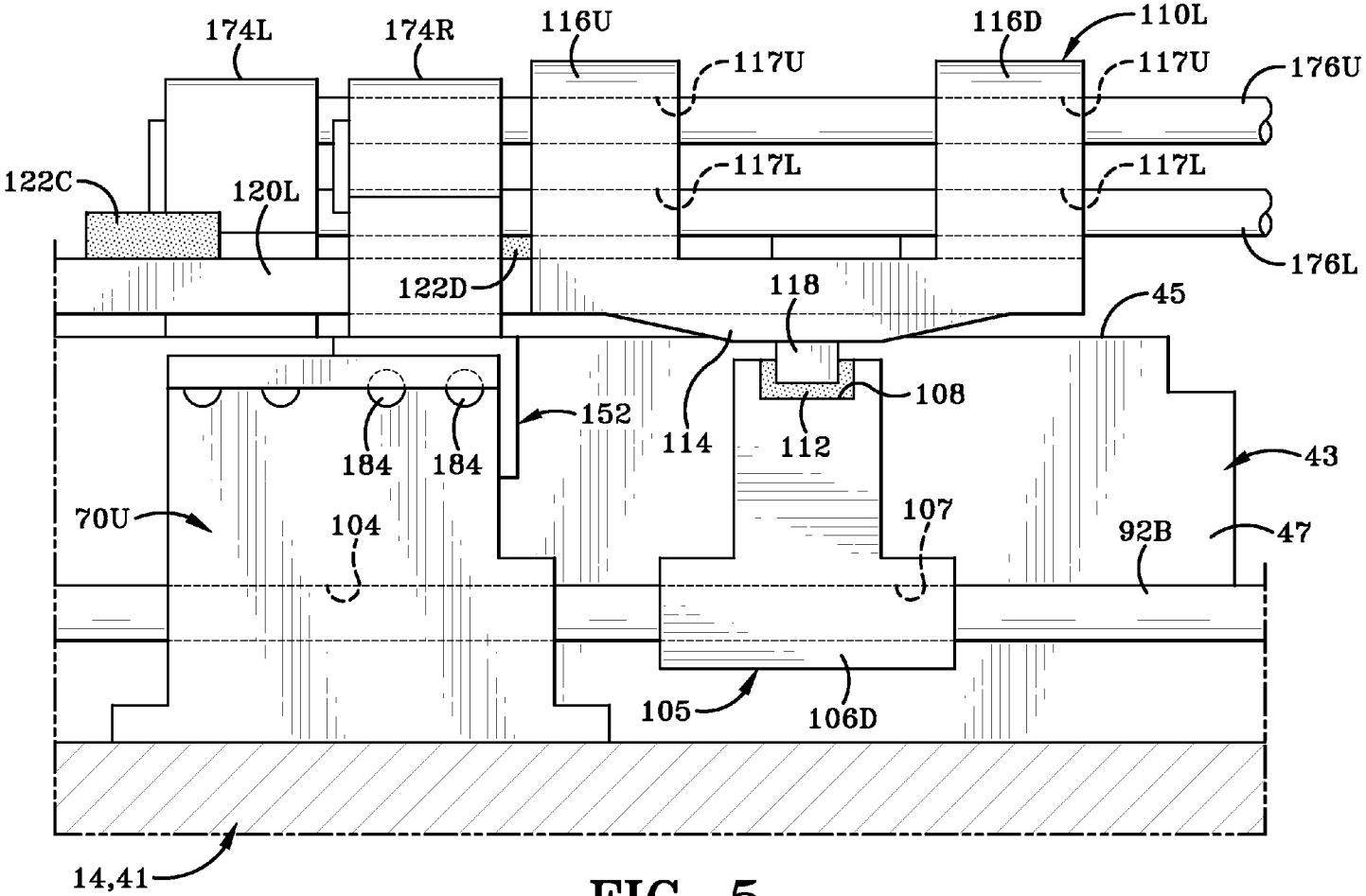
FIG. 5 is an enlarged sectional view taken on line 5-5 of FIG. 3 showing portions of the longitudinal movement drive train and the axial movement drive train.

With primary reference to FIG. 5, drive train 26 further includes a carriage 105 which includes upstream and downstream longitudinal carriage members 106U and 106D, both shown in FIG. 3. Each carriage member 106 defines a pair of horizontal longitudinally elongated rod mounting passages 107 through which rods 92A and 92B respectively pass such that clamping members of carriage member 106 are clamped onto rods 92A and 92B to fixedly secure carriage member 106 to rods 92A and 92B. Each carriage member 106 thus moves with rods 92A and 92B back and forth in a horizontal linear longitudinal direction. Carriage member 106 defines an upwardly opening slide channel or key way 108 which is elongated in the axial direction. Each carriage 105 further includes an axial carriage member 110 which is movable back and forth in the axial direction relative to carriage member 106, as shown at Arrow E in FIG. 3. More particularly, the axial carriage members include left and right carriage members 110L and 110R associated with each lane 62. Thus, as shown in FIG. 3, there is a left axial carriage member 110L to the left of lane 62A and a right carriage member 110R directly opposite carriage member 110L on the right side of lane 62A, and this pattern is the same for each of lanes 62B and 62C. Thus, there is a longitudinal carriage member 106 secured to the rods 92A and 92B which lie between lanes 62A and 62B such that the right carriage member 110R which is between lanes 62A and 62B is slidably received to move axially (Arrow E in FIG. 3) relative to the longitudinal carriage member 106 secured to these two rods 92A and 92B. In addition, FIG. 3 shows a left axial carriage member 110L is closely adjacent the previously noted right carriage member 110R such that these two carriage members are between lanes 62A and 62B and so that the left carriage member 110L is likewise slidably mounted to move axially back and forth on the same longitudinal carriage member 106 which is mounted on the rods 92A and 92B between lanes 62A and 62B.

More particularly, each axial carriage member 110 includes a slide member or slide pad 112 which serves as a key which is slidably received within the slide channel of key way 108 to allow the axial back and forth sliding movement which is a linear movement in the axial direction. Slide member 112 is typically formed of a plastic material having a relatively low coefficient of friction to allow for easy sliding back and forth movement relative to the metal of which carriage member 106 is formed. Each carriage member 110 is a rigid member also typically formed of metal and may include a base 114 with upstream and downstream arms 116U and 116D extending upwardly therefrom whereby carriage member 110 has a U-shaped configuration as viewed from the side. Each arm defines upper and lower slide passages 117U and 117L which are horizontal and longitudinally elongated. Each carriage member 110 may further include a bottom post or projection 118 which extends downwardly from base 114 and on which is mounted the slide pad 112. Carriage 105 further includes a horizontal mounting bar or arm 120 which is rigidly secured to carriage member 110 and is longitudinally elongated. A plurality of can gripping members or fingers 122 are rigidly secured to arm 120 and longitudinally spaced from one another. Fingers 122 are shown as fingers 122A-D wherein finger 122A is the most upstream of the four, with member 122B being spaced downstream therefrom, and members 122C and 122D likewise being serially spaced further downstream therefrom. Gripping fingers 122 are also typically formed of a plastic, rubber or elastomeric material and have arcuate can engaging surfaces 124 which generally face toward respective cavities formed in the die member. More particularly, there are left and right mounting bars or arms 120L and 120R respectively on each side of a given lane 62 each having gripping members or fingers 122 such that the rightward facing can engaging surfaces 124 of the left set of gripping members respectively faces the leftward facing can engaging surfaces 124 of the right set of gripping members 122 which are to the right of the given lane 62.

Figure 6:
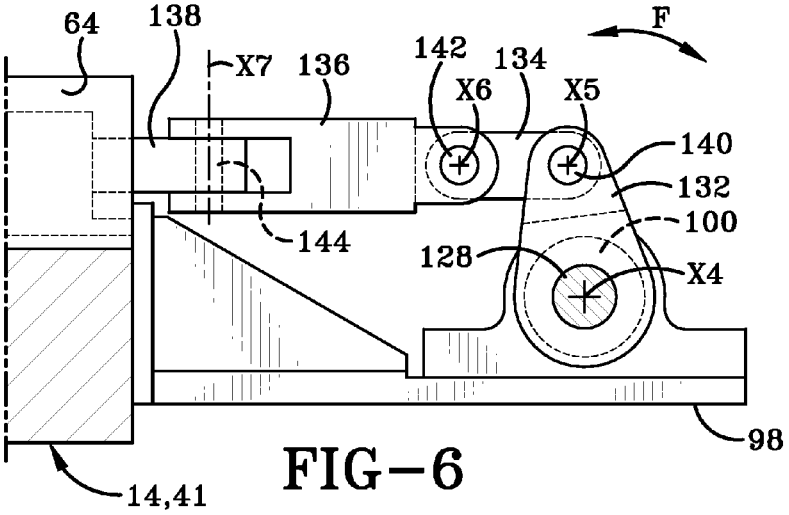
FIG. 6 is an enlarged sectional view taken on line 6-6 of FIG. 3 showing portions of the axial movement drive train.

With primary reference to FIGS. 3 and 6-9, axial movement drive assembly 22 and axial drive train 3 are described in greater detail. As previously discussed, assembly 22 includes servomotors 32L and 32R. Each of servomotors 32 has a rotational output 126 for driving rotation of a straight axially elongated drive shaft 128 about a horizontal axially extending axis X4 which is parallel to axes X1-X3. Drive shaft 128 is spaced downstream of the downstream end of die base 41 and is substantially parallel to drive shaft 84. Drive train 30 includes four drive train subassemblies 130 which are operatively connected to drive shaft 128, servomotors 32, axial carriage members 110 and fingers 122. Each subassembly 130 includes a pivot arm 132, a pivot link 134, a bar or rod mount 136, and a straight horizontal longitudinally elongated bar or rod 138 which is substantially perpendicular to drive shafts 84 and 128 and serves as a longitudinal slider which slides back and forth substantially horizontally in the longitudinal direction. Referring to FIG. 6, pivot arm 132 is rigidly secured to and rotatable with drive shaft 128 about axis X4 (Arrow F). Pivot link 134 is pivotally connected to pivot arm 132 at a pivot 140 whereby pivot arm 132 and pivot link 134 are pivotable relative to one another about an axis X5 which is parallel to axis X4. Rod mount 136 is pivotally connected to pivot link 134 about another pivot 142 such that pivot link 134 and rod mount 136 are pivotable relative to one another about an axis X6 which is parallel to axes X4 and X5. Rod 138 is pivotally connected to rod mount 136 about a pivot 144 such that mount 136 and rod 138 are pivotable relative to one another about a vertical axis which is thus perpendicular to axes X4-X6.

Figure 7:
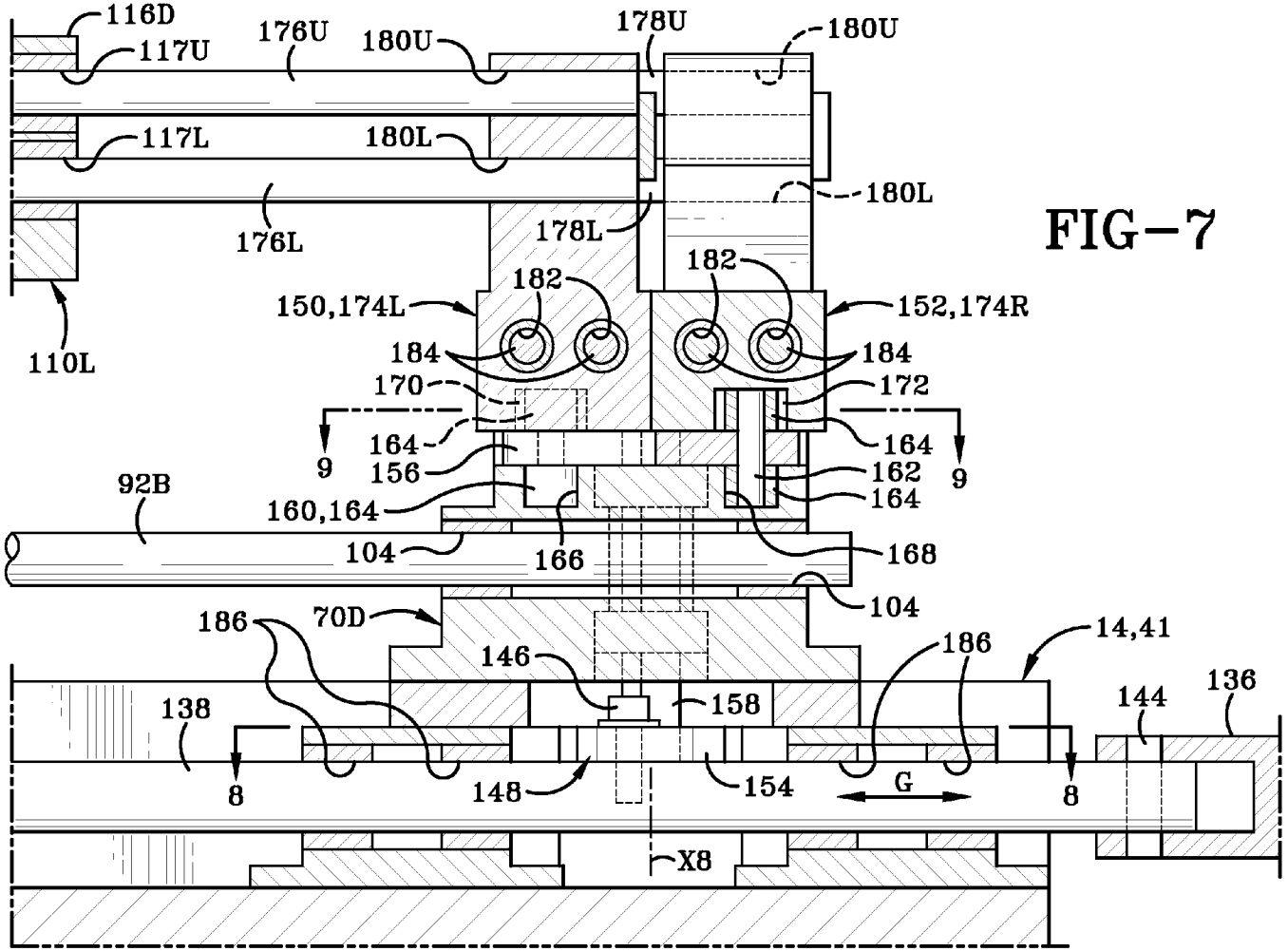
FIG. 7 is an enlarged sectional view taken on line 7-7 of FIG. 3 primarily showing portions of the axial movement drive train.
Figure 8:
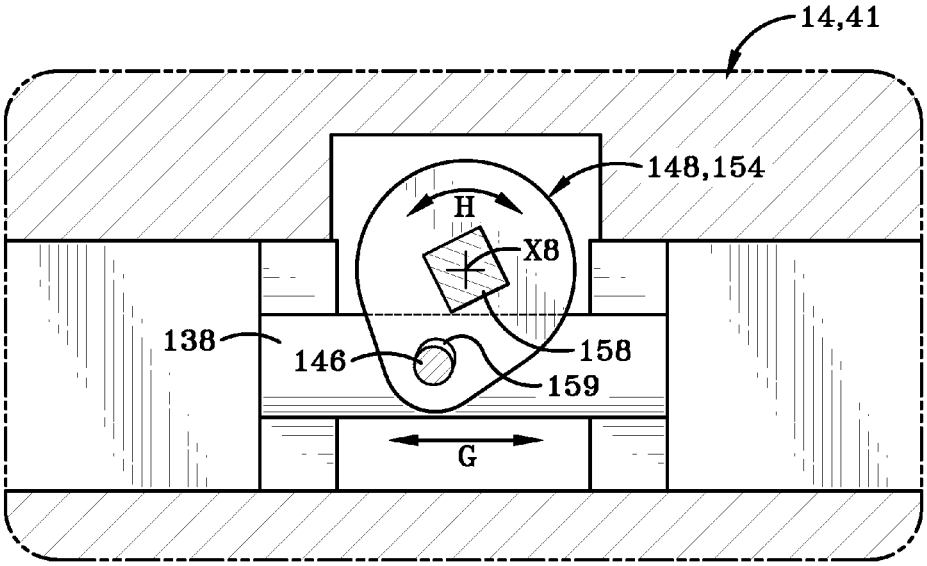
FIG. 8 is an enlarged sectional view taken on line 8-8 of FIG. 7.
Figure 9:
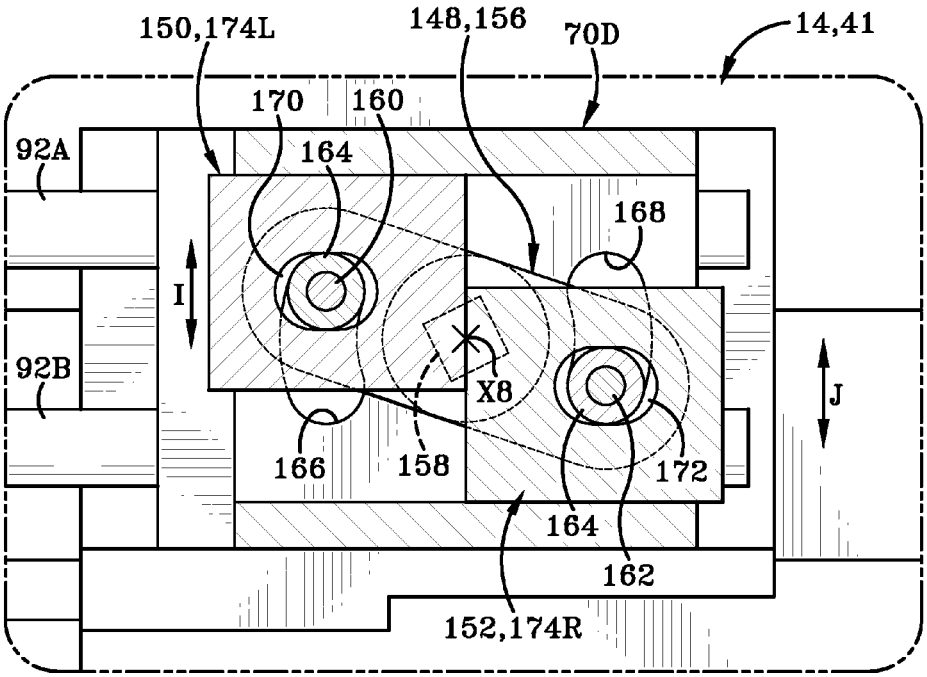
FIG. 9 is an enlarged sectional view taken on line 9-9 of FIG. 7.

Referring now to FIG. 7, drive train 30 further includes a slider post 146, a crank 148, a left axial slider 150 and a right axial slider 152. Slider post 146 is secured to and extends upwardly from rod or longitudinal slider 138. Crank 148 includes a lower crank member 154, an upper crank member 156, and a generally vertical crank shaft 158 which is rigidly secured to and extends between lower and upper crank members 154 and 156. Lower crank member 154 defines an opening or hole 159 (FIG. 8) in which post 146 is received. Drive train 30 further includes a first crank post 160 and a second crank post 162 which are rigidly secured to upper crank member 156 and may include enlarged heads 164 above and below upper crank member 156. Mounting block or housing 70D defines a first arcuate lower opening, cavity or slot 166 (FIG. 9) and a second arcuate lower cavity or slot 168 each of which is below upper crank member 156 and concentric about a vertical axis X8 which passes through crank shaft 158 and about which crank 148 is pivotable back and forth. Sliders 150 and 152 respectively define upper openings, cavities or slots 170 and 172 which are directly above cranker member 156 and slots 166 and 168. Lower slots 166 and 168 receive therein the lower heads 164 of posts 160 and 162 respectively, while upper slots 170 and 172 receive therein enlarged heads 164 of the respective posts 160 and 162. It is noted that block or housing 70D defines various cavities or interior chambers in which are disposed various components of drive train 30, including a portion of rod 138, slider post 146, crank 148 including lower and upper crank members 154 and 156 and crank shaft 158 along with portions of posts 160 and 162. It is further noted that the upstream mounting block or housing 70U (FIGS. 3, 5) has a similar configuration which houses the same type of components which serve in the same manner with respect to translating the longitudinal movement of rod 138 into the axial movement of left and right axial sliders corresponding to left and right axial sliders 150 and 152 via rotation of a crank analogous to crank 148.

Left axial slider 150 includes a left rod mount 174L, while right axial slider 152 includes a right rod mount 174R which is similar to mount 174L except that the top portion thereof is offset to the right relative to the top portion of mount 174L, as most easily seen in FIG. 2. Left axial slider 150 further includes straight horizontal longitudinally elongated parallel upper and lower rods 176U and 176L. Similarly, right axial slider 152 includes straight horizontal longitudinally elongated parallel upper and lower rods 178U and 178L, which are substantially parallel to rods 92A, 92B, 138, 176U and 176L and substantially perpendicular to drive shafts 84 and 128. Each of rod mounts 174L and 174R defines upper and lower rod receiving passages 180U and 180L such that the rod receiving passages 180 of left rod mount 174L receives therein rods 176U and 176L respectively, and the passages 180U and 180L of right rod mount 174R receives respectively therein rods 178U and 178L. Thus, rods 176 are fixedly secured to rod mount 174L, while rods 178 are fixedly secured to rod mount 174R. Left axial slider 150 also includes axial carriage member 110L, which was described further above. Upper and lower slide passages 117U and 117L of member 110L slidably receive therein rods 176U and 176L respectively such that carriage member 110L is linearly slidable in a longitudinal horizontal direction along rods 176.

As shown in FIG. 7, each of rod mounts 174 defines parallel axial slide passages 182 which are horizontal and axially elongated. Respective parallel axial rods 184, which are horizontal and axially elongated, are rigidly secured to mounting block 70 and slidably received respectively in passages 182 so that rod mounts 174 are horizontally slidable back and forth in the axial direction (Arrows I and J in FIG. 9). Mounting block 70 also defines longitudinal slide passages 186 which are horizontal and longitudinally elongated and slidably receive therein rod or longitudinal slider 138. Thus, slider 138 is longitudinally horizontally movable back and forth as shown at Arrow G in FIG. 7, along with slider post 146, which drives the back and forth pivoting movement (Arrow H in FIG. 8) of crank 148 including posts 160 and 162 about vertical axis X8, whereby the upper enlarged heads 164 of posts 160 and 162 engage rod mounts 174L and 174R respectively within slots 170 and 172 to cause the respective linear horizontal axial movement of left and right rod mounts 174L and 174R as shown at Arrows I and J in FIG. 9. This opposite axial movement illustrated at Arrows I and J thus respectively applies to the entire left axial slider 150 and right axial slider 152. Thus, the longitudinal movement of slider 138 is translated to the axial movement of axial sliders 150 and 152 in opposite directions via rotation of crank 148.

Figure 10:
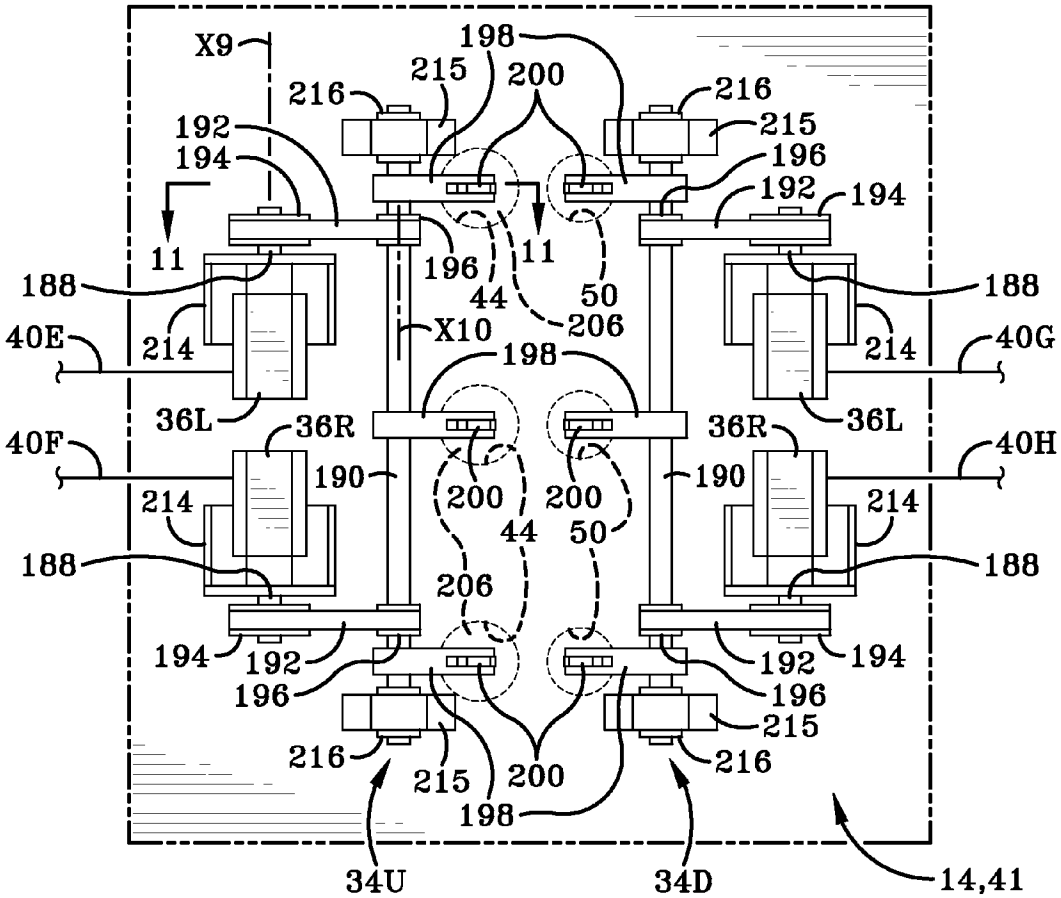
FIG. 10 is a bottom plan view showing a portion of the die and the ejector assembly.
Figure 11:
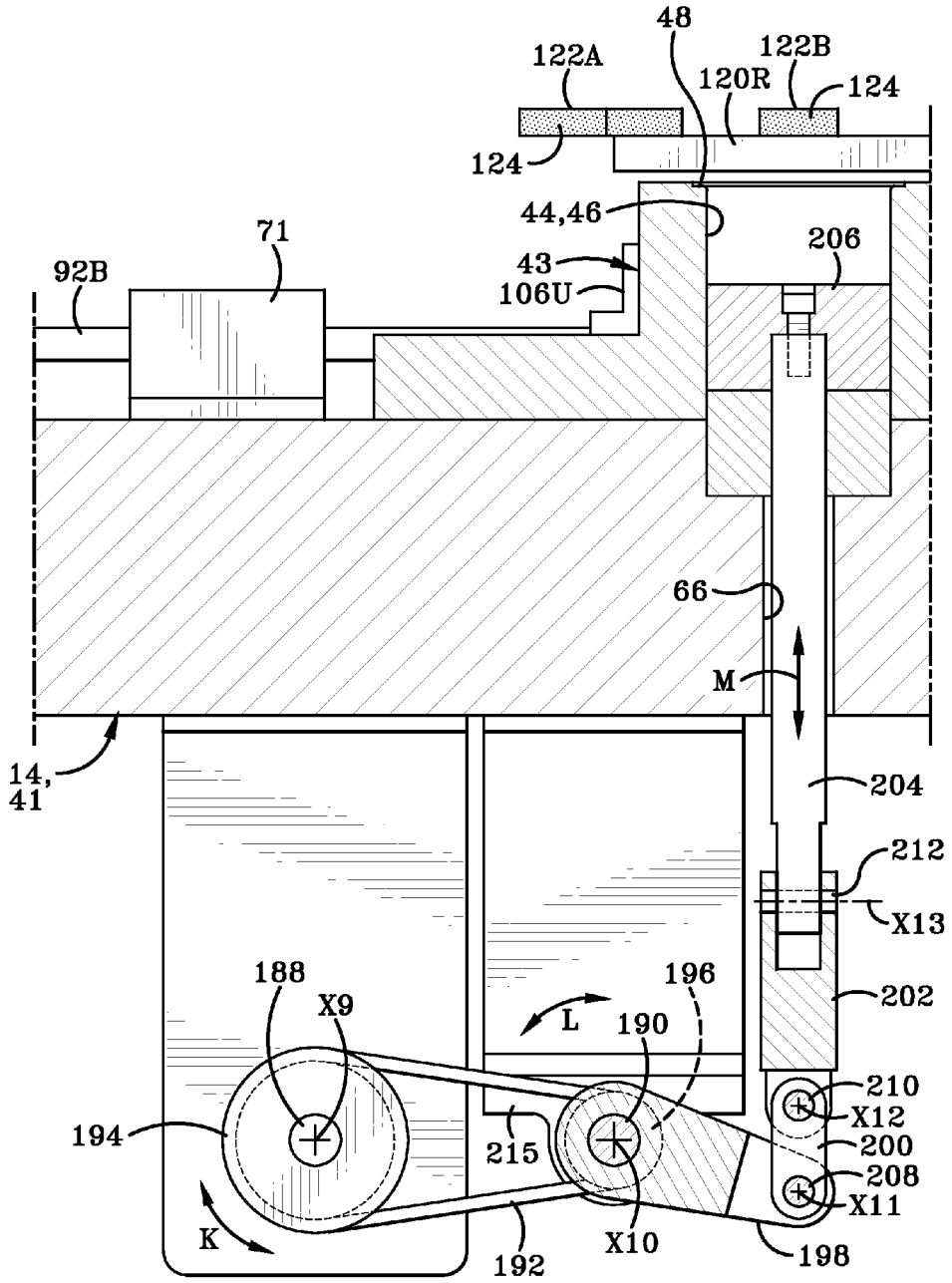
FIG. 11 is an enlarged sectional view taken on line 11-11 of FIG. 10 showing portions of the ejector drive train.

With primary reference to FIGS. 10 and 11, ejector drive assembly 24 and ejector drive trains 34U and 34D are described in greater detail. Each of drive trains 34 is essentially the same and shown as a mirror image of the other whereby reference will be made as if describing only one except as otherwise noted. Each servomotor 36L and 36R has a rotational output 188 which is rotatable back and forth (Arrow K in FIG. 11) about a horizontal axis X9 to drive back and forth rotation (Arrow L in FIG. 11) of a straight horizontal axially extending drive shaft 190 about an offset horizontal axis X10, which is substantially parallel to axes X1-X6 and X9. A pair of continuous loop drive belts 192 respectively engage and revolve around a motor sheave 194 and a drive shaft sheave 196 which are respectively secured to output 188 and drive shaft 190 to translate rotational movement of output 188 to drive shaft 190. Drive train 134 further includes a pivot arm 198, a pivot link 200, a rod mount 202, a straight ejector bar or rod 204 and an ejector 206. Pivot arm 198 is fixedly secured to drive shaft 190 to pivot (Arrow L) back and forth therewith about axis X 10. Link 200 is pivotally connected to arm 198 at a pivot 208 so that link 200 and arm 198 are pivotable relative to one another about an axis X11 which is parallel to and offset from axes X9 and X10. Rod mount 202 is pivotally connected to link 200 at a pivot 210 so that rod mount 202 and link 200 are pivotable relative to one another about an axis X12 which is parallel to and offset from axes X9-X11. Rod 204 is pivotally connected to rod mount 202 at a pivot 212 so that rod mount 202 and rod 204 are pivotable relative to one another about a horizontal axis X13 which is perpendicular to axes X9-X12. Each ejector rod 204 extends upwardly from below a respective passage 66 into and through said passage 66 and into the respective cavity 44 or 50, in which are respectively disposed ejectors 206. Ejector rod 204 and ejector 206 are movable back and forth upwardly and downwardly (Arrow M in FIG. 11) with ejector 206 in the corresponding cavity 44, 50 between a lowered or retracted non-ejecting position (FIG. 11) and a raised or extended ejecting position (FIG. 13).

The operation of machine 1 is now described with primary reference to FIGS. 12-19. The specific control of press 1 will be set up according to the specific type of can blank to be redrawn on press 1 and ultimately formed into a can on additional machinery. The operator of press 1 may use control panel 38 (FIG. 1) to input various control parameters, as will be discussed in greater detail below, or such control parameters may be set in advance. In accordance with such control parameters in a computer program, longitudinal drive assembly 20, axial drive assembly 22 and ejector drive assembly 24 are operated along with the pressing motion of press sections 16 and 18 to move can blanks 218 downstream through the various lanes 62 into proper positions therein to be redrawn, trimmed and discharged. More particularly, servomotors 32 (FIGS. 1, 3) are controlled to rotate their rotational outputs 126 back and forth in opposite directions to control the inward and outward movement of the various sets of fingers 122 via axial drive train 30, servomotors 28 (FIGS. 1, 3) are controlled to rotate their rotational outputs 82 back and forth in opposite directions to control the longitudinal upstream and downstream movement of the various sets of fingers 122 via longitudinal drive train 26, and servomotors 36 (FIGS. 1, 6) are controlled to rotate their rotational outputs 188 back and forth in opposite directions to control the upward and downward movement of the ejectors 206 via ejector drive trains 34.

Figure 12:
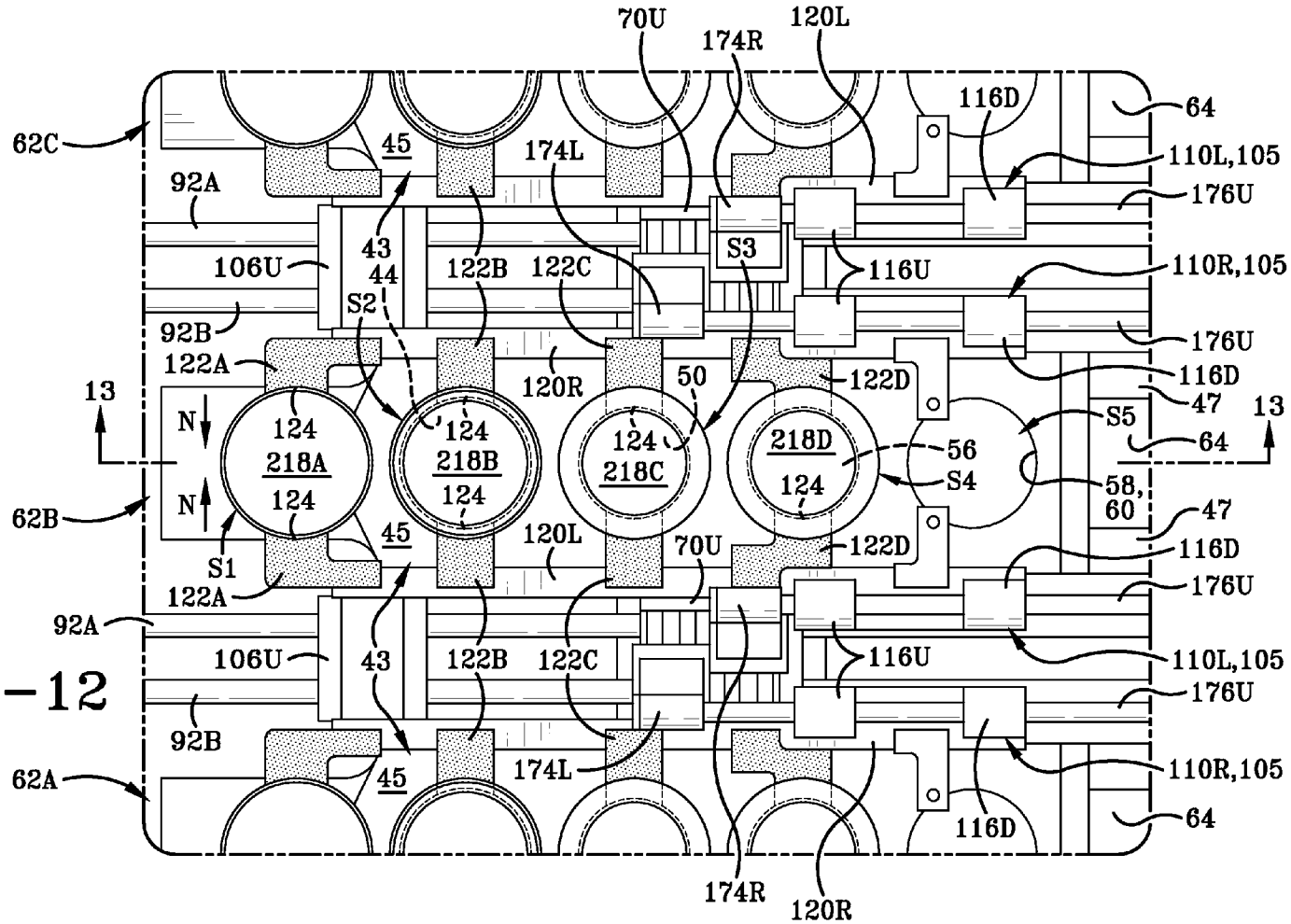
FIG. 12 is an enlarged top plan view looking down on the die and showing a stage of operation in which in four can blanks are positioned in each lane with one of the can blanks upstream of the die cavities, one of the can blanks positioned above the upstream redrawing die cavity, one of the can blanks above the subsequent redrawing die cavity and one of the can blanks atop the resting station, with the four sets of gripping members respectively gripping the four can blanks.
Figure 13:
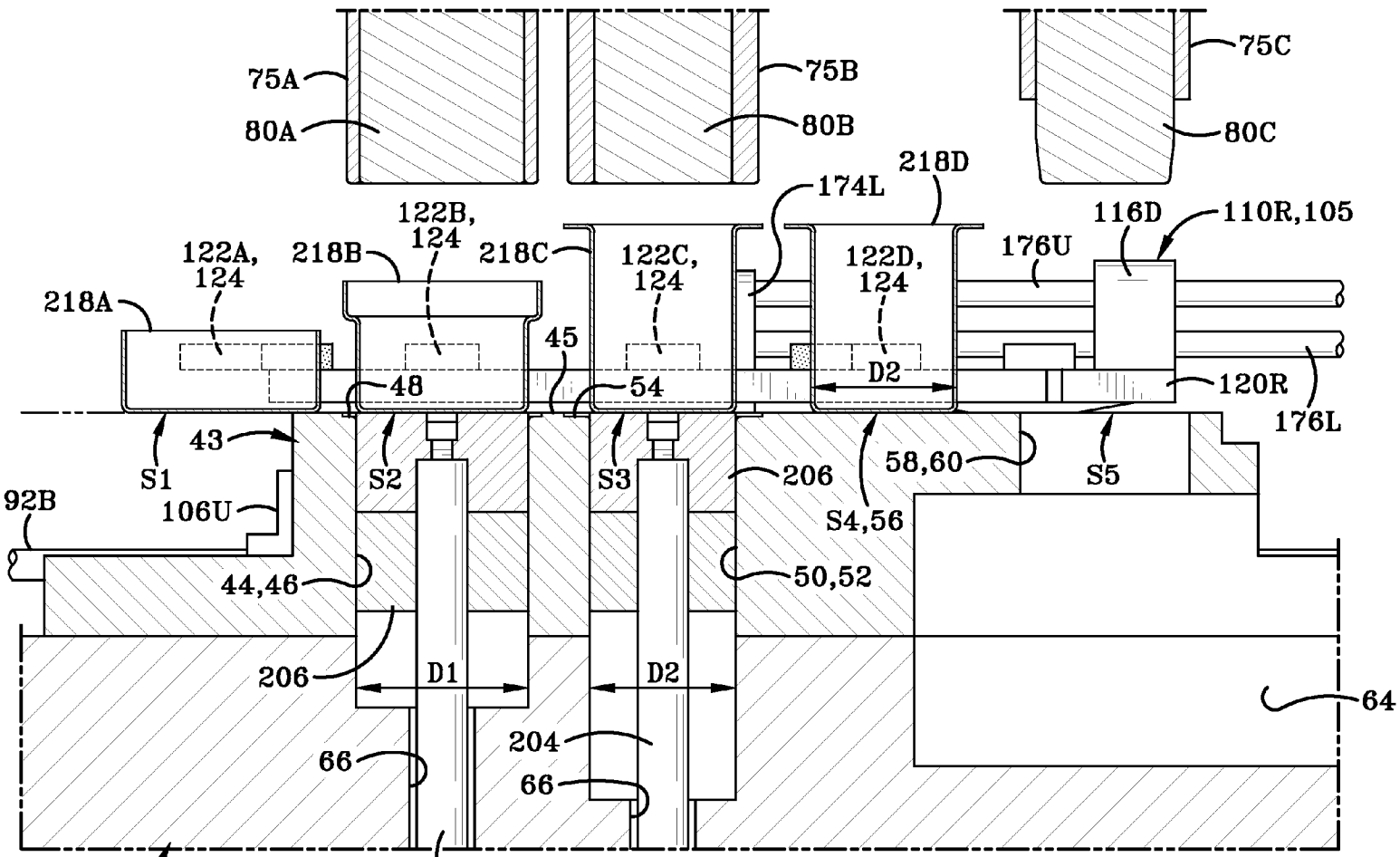
FIG. 13 is a sectional view taken on line 13-13 of FIG. 12 showing the can blanks at the same stage with the ejectors in the raised position and the punches in the raised position.

At the stage shown in FIGS. 12 and 13, can blanks 218 have been fed downstream toward a given lane of the die by any suitable conveyor or feed mechanism (not shown). Axial movement drive assembly 22 has been operated to move fingers 122 inwardly (Arrows N in FIG. 12) from their can blank out or disengaged positions (FIG. 3) to their can blank in or engaged positions so that sets 122A-122D respectively engage can blanks 218A-218D. The surfaces 124 of each pair of fingers 122 more particularly engage an outer perimeter of a given can blank 218 on opposite sides thereof. As shown in FIG. 13, punches 80 and ejectors 206 are in the raised position with can blanks 218B and 218C respectively atop ejectors 206 external to cavities 44 and 50. Can blank 218A is upstream of cavities 44 and 50 at a first station S1 and thus has not yet been redrawn on machine 1. Can blank 218B, at a second station S2 downstream of and adjacent station S1, has been redrawn by punch 80A within cavity 44 and ejected therefrom by ejector 206 within cavity 44, thus having decreased in diameter (essentially the same as diameter D1) from that of the diameter of the blank 218A, and is likewise taller and has thinner walls. Can blank 218C, at a third station S3 downstream of and adjacent station S2, which in a previous step was also redrawn by punch 80A within cavity 44 and ejected therefrom, has also been redrawn by punch 80B within cavity 50 and ejected therefrom by ejector 206 in cavity 50. Thus, blank 218C has a smaller diameter (essentially the same as diameter D2) than that of blank 218B, and is also taller and has thinner walls. Can blank 218D, at a fourth station S4 downstream of and adjacent station S3, has substantially the same dimensions as blank 218C, having gone through the same redrawing steps, and is one station downstream of blank 218C at rest station 56 or S3. FIGS. 12 and 13 also show a fifth station S5, at which no can blank is yet positioned, downstream and adjacent station S4.

Figure 14:
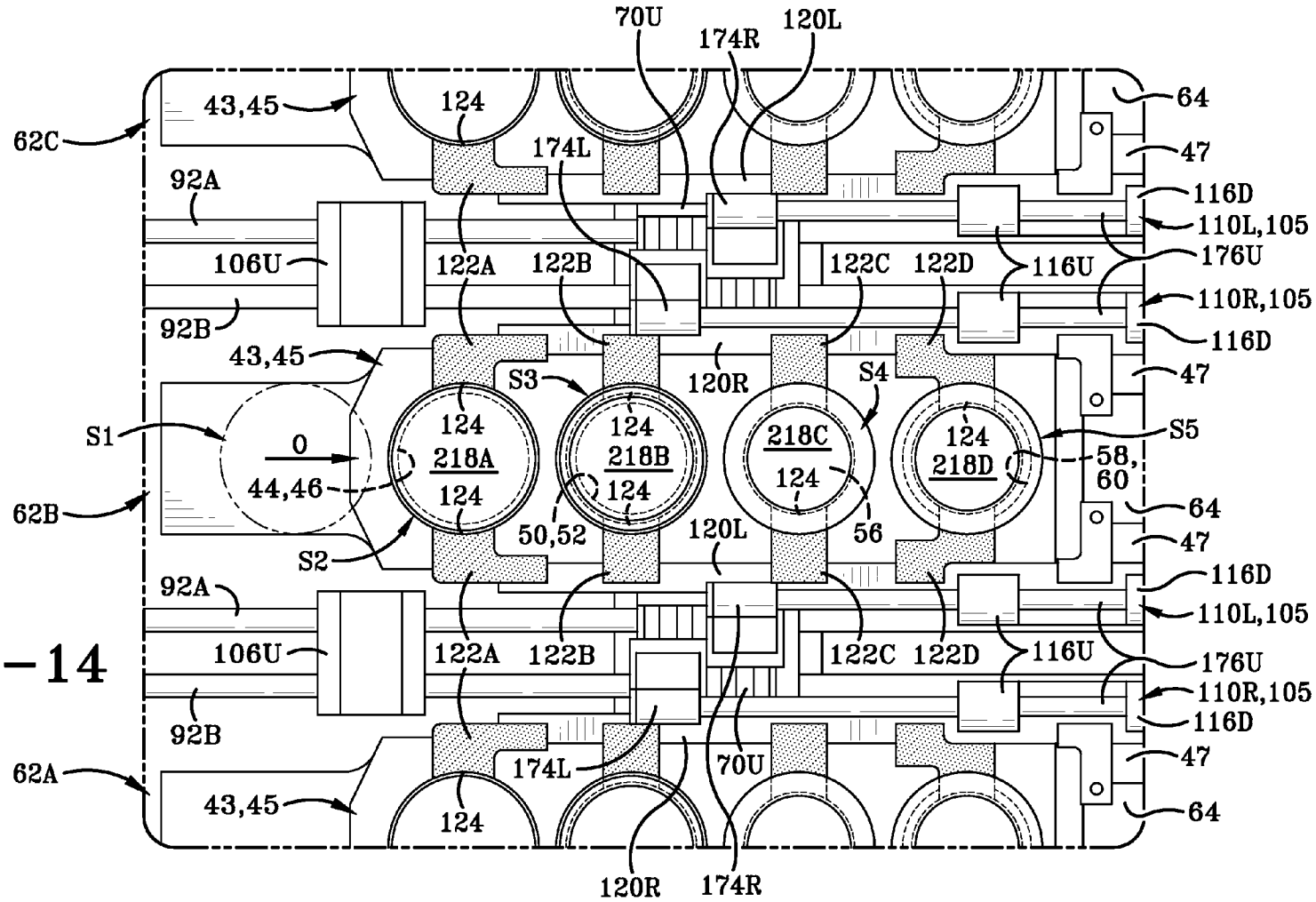
FIG. 14 is a top plan view similar to FIG. 12 showing the can blanks having been moved downstream so that one can blank is above the upstream redrawing die cavity, one can blank is above the next redrawing die cavity, one can blank is above the resting station and one can blank is above the trim die cavity.
Figure 15:
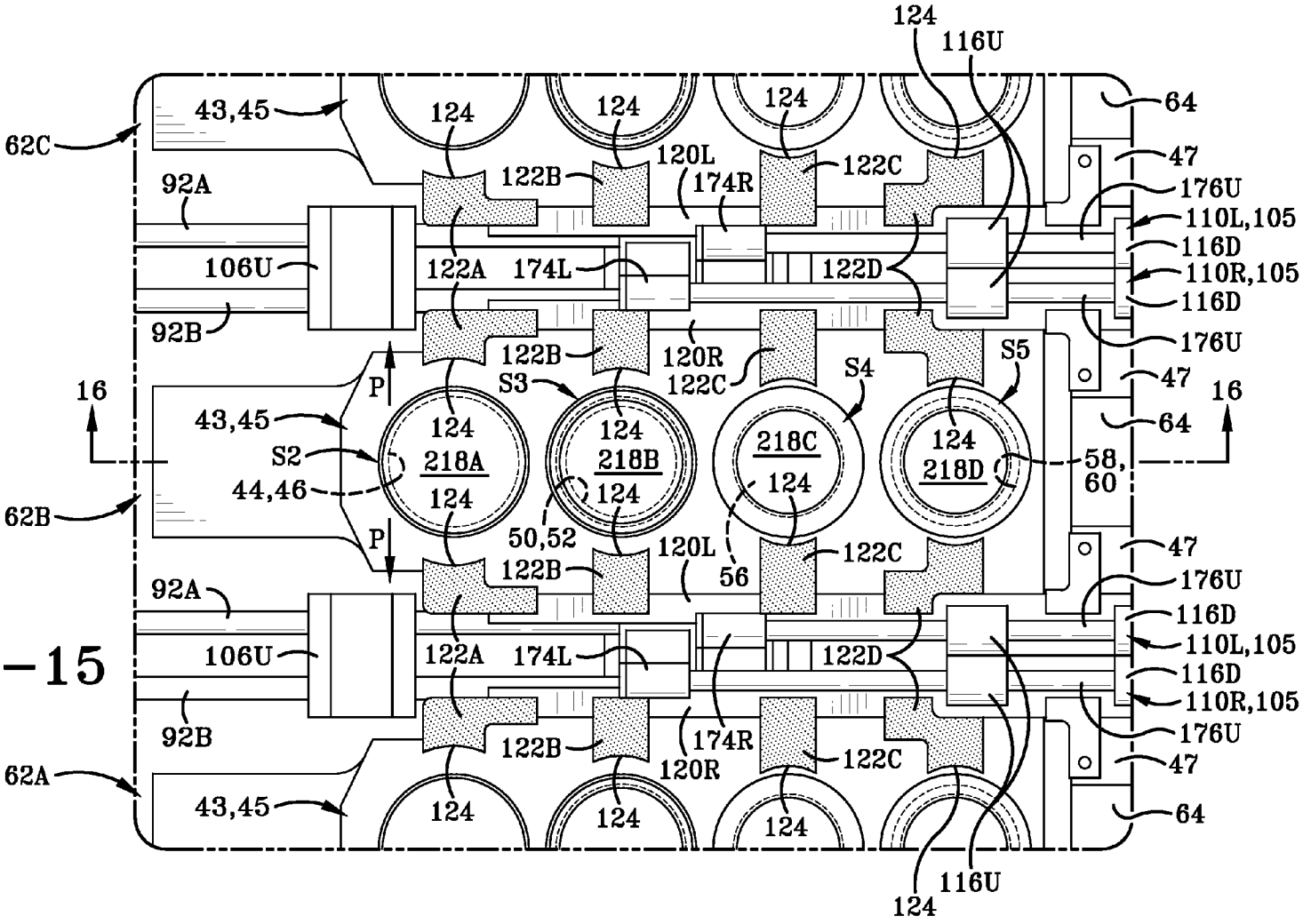
FIG. 15 is similar to FIG. 14 and shows the gripping members having moved outwardly to release the can blanks to allow the punches to move downwardly.
Figure 16:
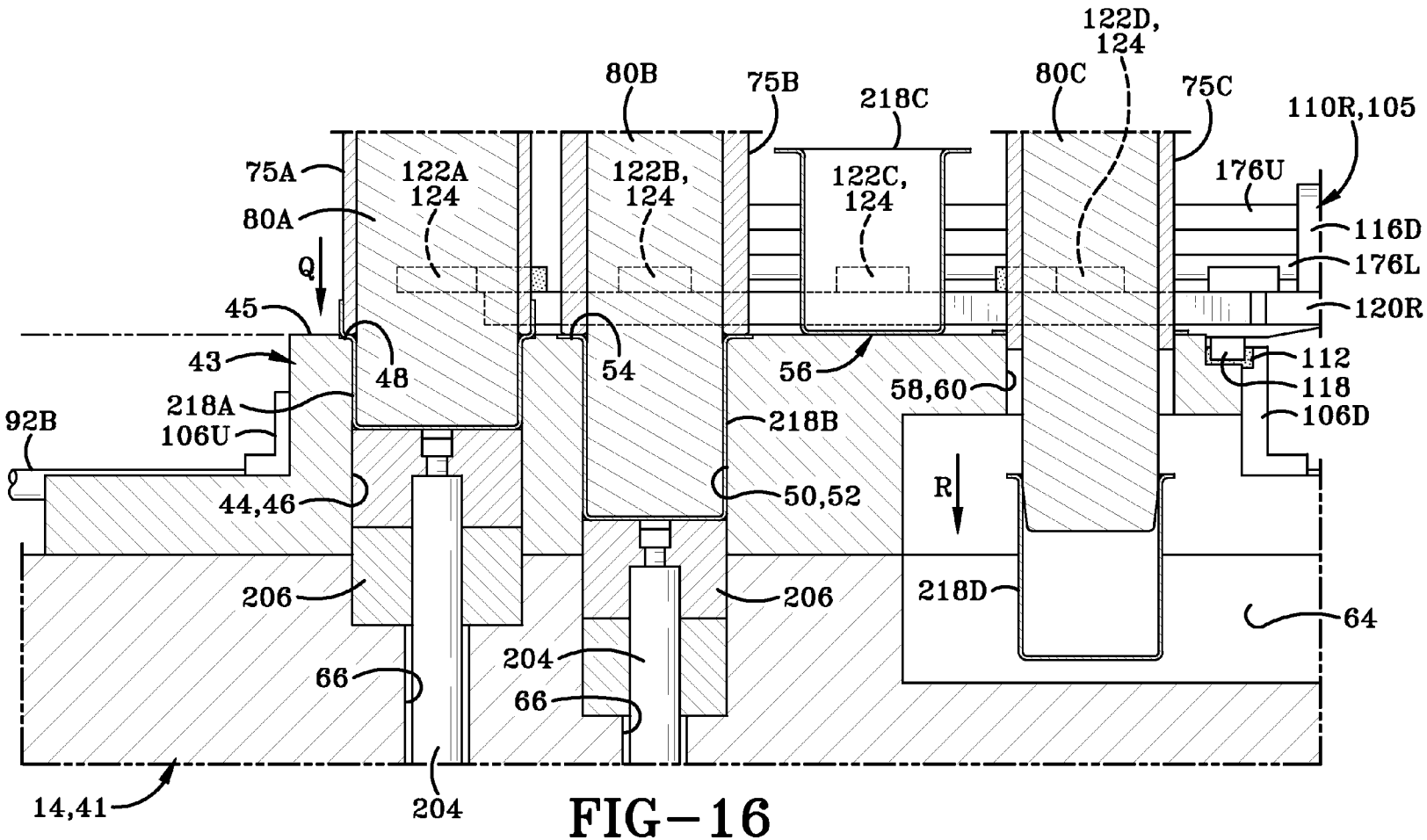
FIG. 16 is a section view taken on line 16-16 of FIG. 15 showing the punches having moved downwardly to their lowered or extended positions.

Referring to FIG. 14, while punches 80 remain in the raised position and while each set of fingers 122 is in its inward gripping position to grip the respective can blanks 218, longitudinal movement drive assembly 20 is operated to move each set of fingers 122 and the gripped can blanks 218 downstream (Arrow O) a longitudinal distance of one station, so that can blank 218A is at station S2, blank 218B is at station S3, blank 218C at station S4 and blank 218D at station S5. While can blanks 218 are at these stations, axial drive assembly 22 is then operated to withdraw fingers 122 outwardly (Arrows P in FIG. 15) to their disengaged positions, thereby releasing can blanks 218. While can blanks 218 are at the stations as shown in FIGS. 14 and 15, the press is then operated as shown in FIG. 16 to move cylinders 75 and punches 80 downward (Arrow Q) from their raised non-punching positions to their lowered punching positions, thereby forcing blanks 218A, 218B and 218D downwardly into cavities 44, 50 and 58 respectively. The lowering or downstroke of cylinders 75 and punches 80 occurs immediately after fingers 122 are out of the path of cylinders 75 and punches 80, thereby allowing fingers 122 to hold can blanks 218 in place at the respective stations as long as possible and also preventing punches 80 or cylinders 75 from contacting and damaging fingers 122. FIG. 16 thus illustrates the first redrawing of can blank 218A by cylinder 75A/punch 80A in cavity 44, the second redrawing of can blank 218B by cylinder 75B/punch 80B in cavity 50 and the trimming of can blank 218D by cylinder 75C/punch 80C in cavity 58 while can blank 218C remains stationary atop the platform of resting station 56, where no deformation occurs to can blank 218C. (It is noted, however, the die may be configured with another smaller diameter cavity at station S4 instead of it being a resting station, such that an additional smaller diameter punch may further redraw the can blank.) The downward movement of punch 80C also causes blank 218D to drop (Arrow R) into discharge trough 64, from where it will be discharged downstream from die 14 by a discharge device which is not shown.

At this stage, can blank 218D has been fully redrawn, trimmed by and discharged from press 1, while can blank 218A has been redrawn only in the first redraw cavity 44, can blank 218B has been redrawn sequentially in the first and second cavities 44 and 50, and can blank 218C has been redrawn like blank 218B and also ejected from cavity 50 and moved downstream to station 56. The fingers 122 are then moved back upstream while in their out or disengaged positions and the punch assemblies are withdrawn to their raised non-punching positions (FIG. 13), immediately followed by the inward movement of fingers 122 to their gripping positions (FIG. 12) and the subsequent downstream movement of fingers 122 and can blanks 218A-C to the next stations to sequentially repeat the process with these can blanks and others not shown.

Figure 17:
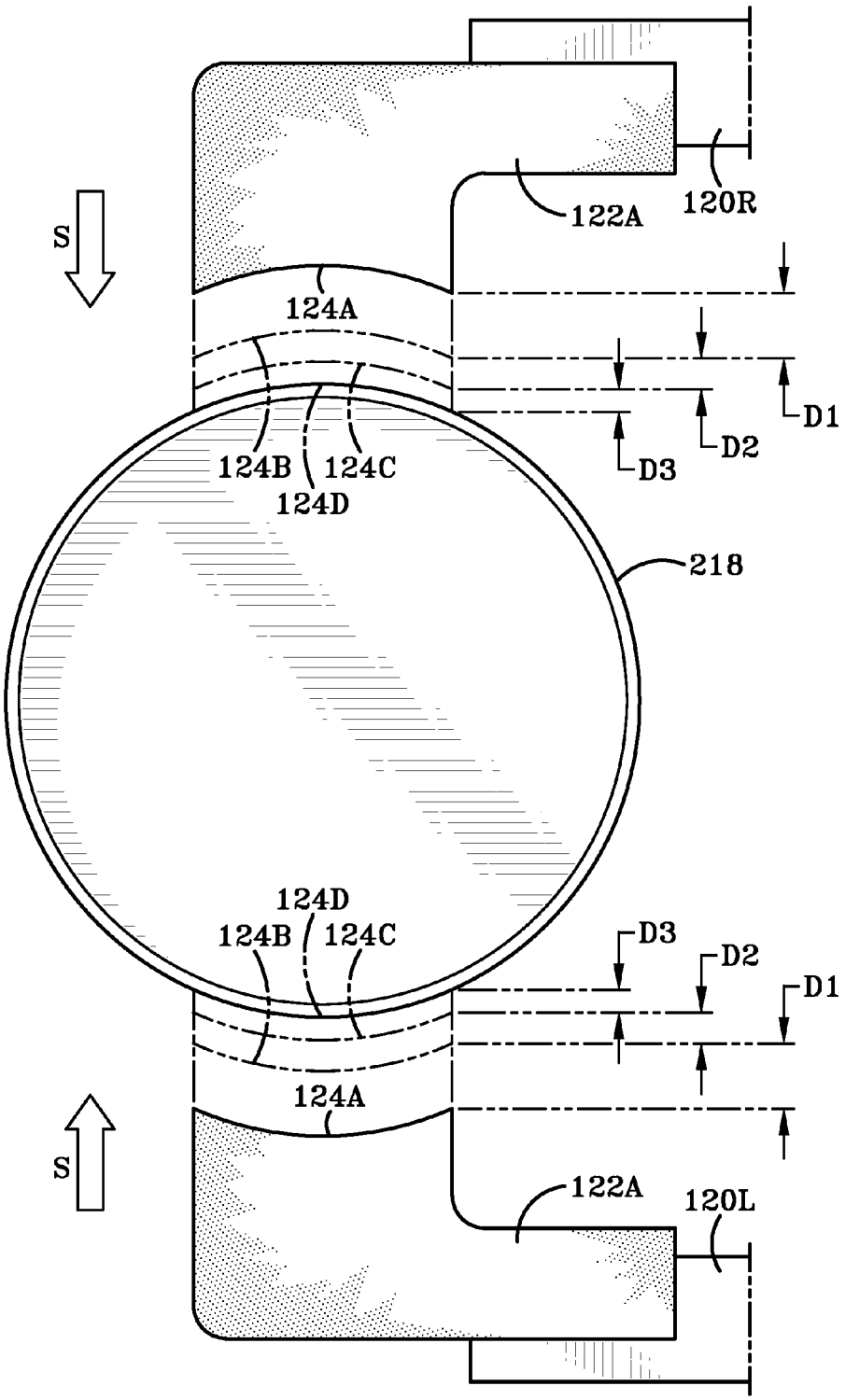
FIG. 17 is a diagrammatic top plan view of a can blank and a pair of gripping members illustrating the ability to move the gripping members axially at different rates.

The more detailed control of fingers 122 and ejectors 206 are discussed with reference to FIGS. 17-19. In particular, FIG. 17 shows the axial inward movement (Arrows S) of the two fingers 122 of a given set toward a can blank 218. Each finger 122 is shown in solid lines in a disengaged position, which is in this case its outmost position. Dot dash lines (mostly of gripping surfaces 124B and 124C) are used to show two additional intermediate positions of each finger 122 which are also disengaged from can blank 218, while a solid line 124D along the outer perimeter of can blank 218 represents the inmost or engaged position in which surfaces 124 engage the outer perimeter of can blank 218. These four positions may be more easily understood by referring to the position of the gripping surfaces, so that the outmost gripping surface position is denoted 124A, the next position further inward at 124B, the next position further inward at 124C and the inmost engaged or gripping position at 124D. Thus, the axial travel distance of finger 122 from position 124A to position 124B is denoted at D1; the axial travel distance of finger 122 from position 124B to position 124C at D2; and from position 124C to position 124D at D3, whereby the total axial travel distance from position 124A to position 124D equals D1 plus D2 plus D3.

One advantage of machine 1 is the ability to control the axial travel distance and the axial travel rate of fingers 122 for a given axial travel distance. Thus, axial servomotors 32 (FIGS. 1, 3) may be controlled by a computer program, which may be set via inputs at control panel 38 to move fingers 122 axially at a constant rate of travel throughout the total axial travel distance, or to change the axial travel rate as desired. For example, the axial rate of travel may be different for each of distances D1, D2 and D3, or the travel rate may be the same for any two of distances D1, D2 and D3 and different for the other distance. Distances D1, D2 and D3 are shown by way of example and are not intended to represent specific distances nor to limit the number of distances which could be represented for control by machine 1. The travel rates over a given distance may change relatively rapidly or relatively slowly. In some instances, such as when a given can blank will have very thin walls and/or when the can blank is made of relatively weaker metals (for instance, an aluminum alloy), it may be desirable for fingers 122 to make their final approach before coming into contact with the can blank at a relatively slow rate to prevent fingers 122 from damaging the can blank. In such a case, the axial travel rate over distance D3 may be significantly less than that over distances D1 or D2. Also, given that fingers 122 and punch assembly 75, 80 move into a common space at different times to avoid contact between the fingers and punch assembly, fingers 122 must wait to move inward into this common space until the punch assembly is removed from the common space, for instance, as the bottom of the given cylinder 75 and given punch 80 moves upwardly to a position higher than the tops of corresponding fingers 122. As the punching rate increases (that is, the rate of moving the punches between the punching and non-punching positions increases, or the upstroke and downstroke rates increase), fingers 122 will have less time to be within the common space in order to avoid contact with the punch assembly. Thus, it may be desirable to move fingers 122 axially inward at relatively rapid rates (for example, over distances D1 and/or D2) while still approaching the can blank (for example, over distance D3) at a substantially lower rate. Likewise, the movement of fingers 122 outwardly may also be controlled to move at a constant rate or at varying rates.

Figure 18:
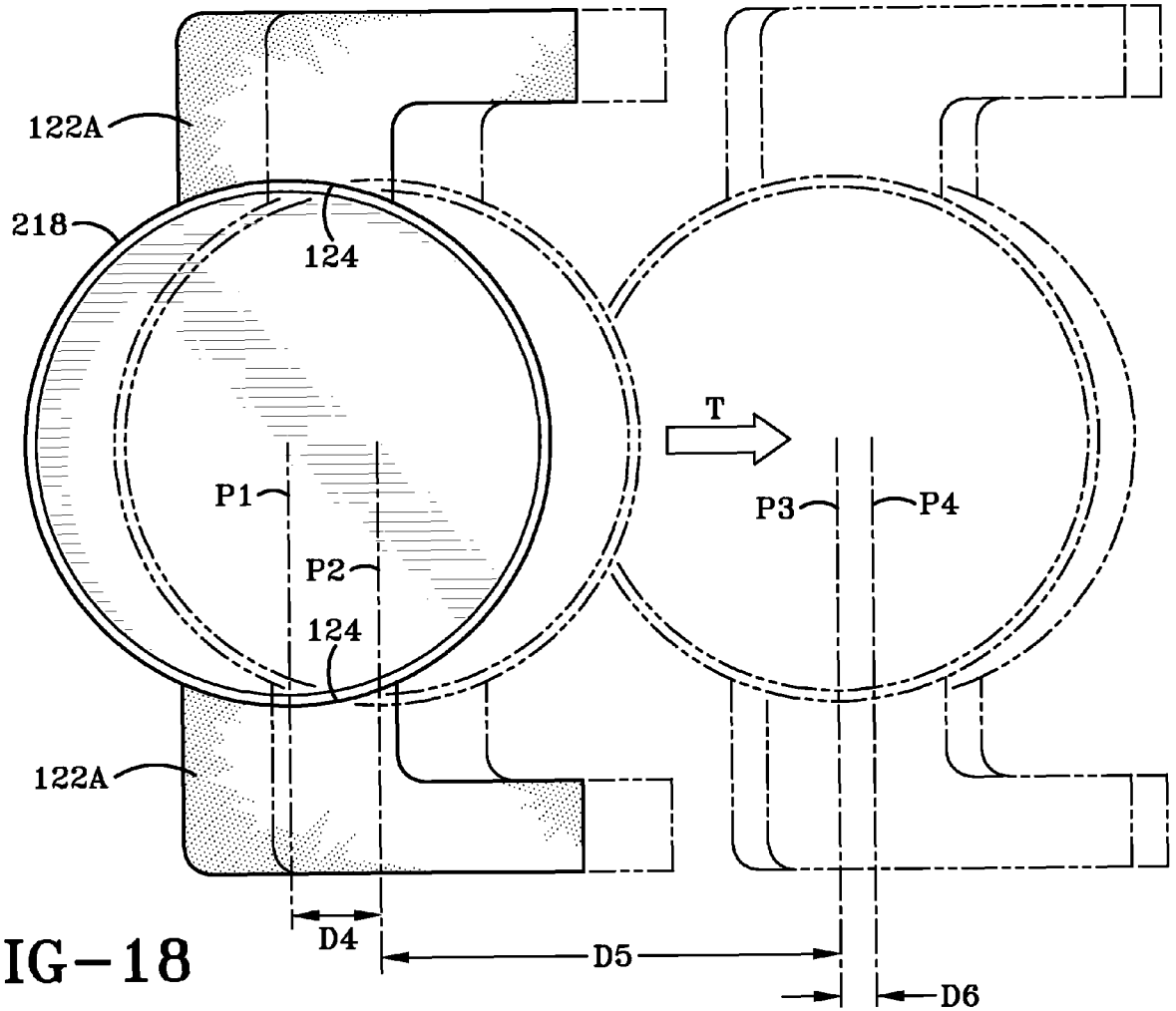
FIG. 18 is a diagrammatic top plan view of a can blank and a pair of gripping members illustrating the ability to move the can blank and gripping members longitudinally at different rates.

FIG. 18 shows the longitudinal downstream movement (Arrow T) of the two fingers 122 of a given set and of a can blank 218 carried by the two fingers. Each finger 122 and can blank 218 is shown in solid lines with the fingers engaging the can blank in an upstream position, which may be analogous to a given one of stations S1-S4 (FIGS. 12-15). Dot dash lines are used to show three additional positions of fingers 122 and can blank 218 with fingers 122 also engaging can blank, wherein each of these positions is serially downstream of the solid line position. These four longitudinally spaced positions are denoted P1-P4 using the center of the can blank as a reference point for simplicity. Thus, the longitudinal travel distance of fingers 122 and can blank 218 from position P1 to position P2 is denoted at D4; from position P2 to position P3 at D5; and from position P3 to position P4 at D6, whereby the total longitudinal travel distance from position P1 to position P4 equals D4 plus D5 plus D6. The most downstream position P4 may, for example, represent one of stations S2-S5 (FIGS. 12-15) such that the total longitudinal travel distance may represent that from one of stations S1-S4 to the next downstream station S2-S5 respectively.

Another advantage of machine 1 is the ability to control the longitudinal travel distance and the longitudinal travel rate of fingers 122 and a can blank carried thereby for a given longitudinal travel distance. Thus, longitudinal servomotors 28 (FIGS. 1, 3) may be controlled by the computer program, which may be set by inputs at control panel 38, to move fingers 122 and can blank 218 longitudinally at a constant rate of travel throughout the total longitudinal travel distance, or to change the longitudinal travel rate as desired. For example, the longitudinal rate of travel may be different for each of distances D4, D5 and D6, or the travel rate may be the same for any two of distances D4, D5 and D6 and different for the other distance. Distances D4, D5 and D6 are shown by way of example and are not intended to represent specific distances nor to limit the number of distances which could be represented for control by machine 1. The travel rates over a given distance may change relatively rapidly or relatively slowly. In some instances, such as when a given can blank will have very thin walls and/or when the can blank is made of relatively weaker metals (for instance, an aluminum alloy), it may be desirable for fingers 122 to begin moving downstream from a stop, for instance from position P1 to position P2, at a relatively slow rate to prevent fingers 122 from damaging the can blank due to too rapid acceleration. In such a case, the longitudinal travel rate over distance D4 may be significantly less than that over distance D5. Furthermore, it may be desired that the longitudinal travel rate over distance D6 may be significantly less than that over distance D5 in order to prevent damage to can blank 218 due to too rapid deceleration. Such a setting of relatively slow, then relatively fast, then relatively slow again thus provides the ability to prevent damage to a can blank while also moving the can blank fast enough to be positioned properly before actuation of the punch assemblies.

One common problem that may be avoided by press 1 is the throwing or tossing of can blanks toward a given station, as discussed earlier in the Background section. This problem relates to the fingers releasing the can blank too early during the downstream movement of the fingers and can blank. More particularly, this problem is caused by the fingers moving outwardly before the fingers and can blank have finished their downstream movement from one station to the next station. In this scenario, the fingers and can blank are still moving downstream when the fingers disengage from the can blank whereby the can blank still has downstream momentum and continues to travel downstream in an uncontrolled manner which often leads to incorrect positioning of the can blank and resulting damage to the press. This problem tends to occur in prior art presses especially as the overall speed of the press is increased. In contrast, press 1 provides the ability to control the axial and longitudinal movement of fingers 122 in virtually any manner desired. Thus, the computer program may be configured to control the axial and longitudinal servomotors to, for example, keep fingers 122 in the engaging position until reaching and stopping at a given station at which the can blank is to be positioned, then release the stopped can blank at the given station by moving the fingers outwardly. Such control can be achieved at much higher overall press speeds than in known prior art machines.

Figure 19:
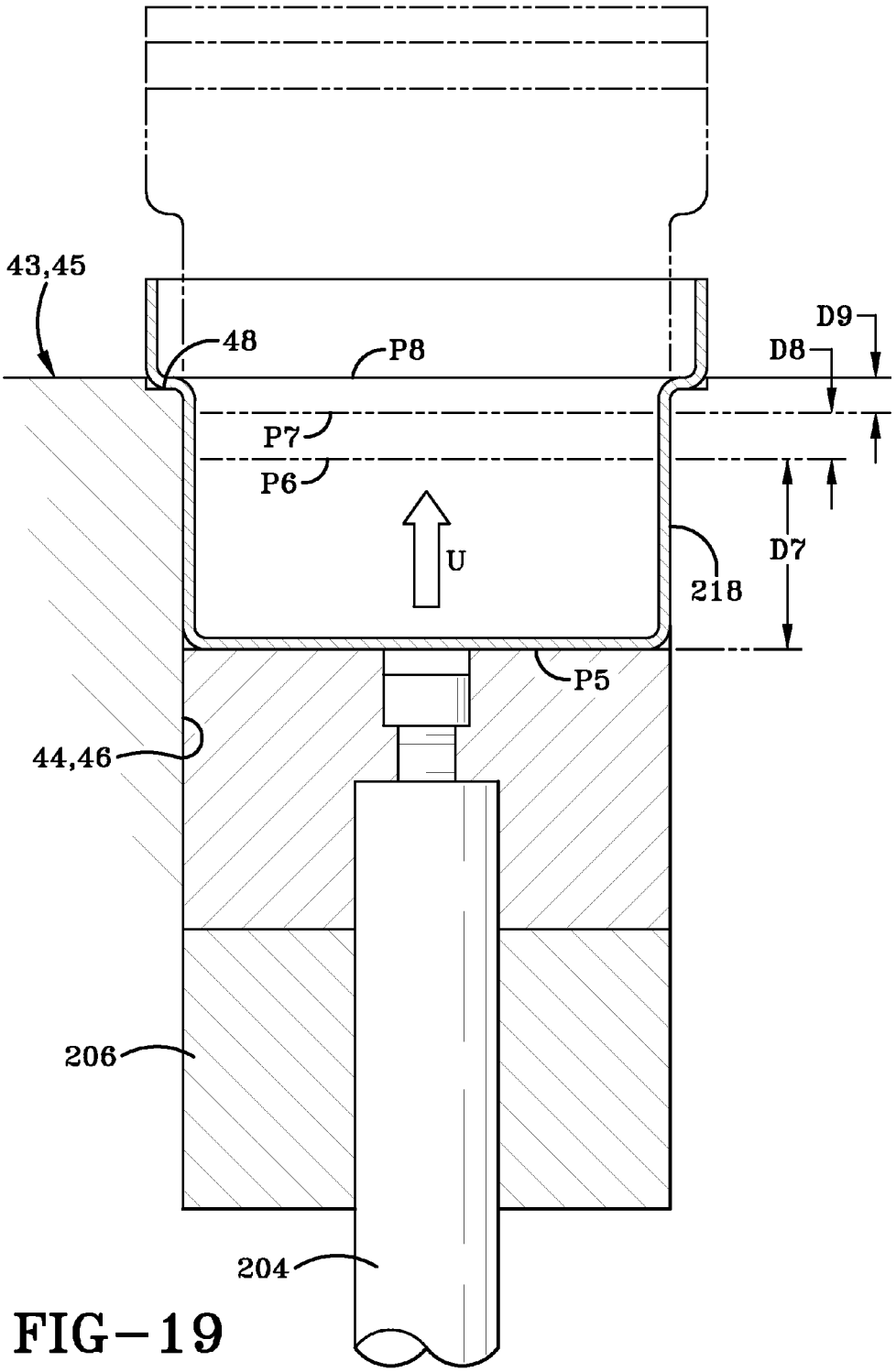
FIG. 19 is a diagrammatic sectional view of one of the die cavities, ejectors and a can blank illustrating the ability to eject the can blank at different rates.

FIG. 19 shows the upward ejecting direction and movement (Arrow U) of the one of ejectors 206 and the can blank 218 atop the ejector. Ejector and can blank 218 are shown in solid lines in a lowermost position P5, while dot dash lines are used to show three additional positions P6-P8 of can blank 218 which are serially upward of the solid line position. Thus, the vertical ejector travel distance of ejector 206 and the vertical can blank travel distance of can blank 218 from position P5 to position P6 is denoted at D7; from position P6 to position P7 at D8; and from position P7 to position P8 at D9, whereby the total vertical travel distance from position P5 to position P8 equals D7 plus D8 plus D9.

Another advantage of machine 1 is the ability to control the vertical ejector travel distance and the vertical ejector travel rate of ejector 206 and can blank being ejected by ejector 206 for a given vertical ejector travel distance. Thus, ejector servomotors 36 (FIGS. 1, 2, 6) may be controlled by the computer program, which may be set by inputs at control panel 38, to move ejector 206 and can blank 218 vertically at a constant rate of travel throughout the total vertical travel distance, or to change the vertical travel rate as desired. For example, the vertical rate of travel may be different for each of distances D7, D8 and D9, or the travel rate may be the same for any two of distances D7, D8 and D9 and different for the other distance. Distances D7, D8 and D9 are shown by way of example and are not intended to represent specific distances nor to limit the number of distances which could be represented for control by machine 1. The travel rates over a given distance may change relatively rapidly or relatively slowly. In some instances, such as for thin-walled can blanks and/or can blanks made of relatively weaker metals, it may be desirable for ejector 206 to begin moving upwardly from a stop, for instance from position P5 to position P6, at a relatively slow rate to prevent ejector 206 from damaging the can blank due to too rapid acceleration. In such a case, the vertical travel rate over distance D7 may be significantly less than that over distance D8. Furthermore, it may be desired that the vertical travel rate over distance D9 may be significantly less than that over distance D8 in order to prevent can blank 218 from being thrown upwardly in an uncontrolled manner due to too high a vertical travel rate near the end of upward travel. Such a setting of relatively slow, then relatively fast, then relatively slow again thus provides the ability to prevent damage to a can blank while also moving the can blank sufficiently fast to keep a relatively high rate of operation of press 1 and to be positioned properly at a given station before fingers 122 move inwardly to grasp a given can blank and move it downstream.

Unlike known prior art presses, press 1 provides an axial drive assembly, longitudinal drive assembly and ejector assemblies which operate independently of one another. This independent operation in part allows for the ability to move can blanks quickly downstream without damaging them and to correctly position can blanks at various stations to be punched without damaging press 1. The computer program of press 1 may be set to control the various servomotors for any different number of scenarios to control the axial drive assembly, the longitudinal drive assembly and the ejector assemblies depending on the material of which the can blanks are made, the size of can blanks and redrawing cavities and punches, and the rates at which various components move. Press 1 may be provided with one computer program which may be a preset program for a single type and size of can blank, or with one or more computer programs which may include different settings which may be selected for varying types and sizes of can blanks. In addition, the one or more computer programs may also be programmable by an operator inputting different types and sizes of can blanks or making individual command inputs to the program via control panel 38 to accordingly individually control movement of one or more of the servomotors and thus the rates and distances which any or all of the axial, longitudinal and ejector drive assemblies impart to the fingers or ejectors.

It is noted that can blanks 218 and many of the components of press 1 have been described herein as moving in various directions. It is further noted that various other terms may be used in the claims in place of the term "move" or "moved" or "moving," such as, for example, various forms of the terms displace, transfer, deliver, forward, travel, change location, and so forth.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

The invention claimed is:

1. A redraw press comprising:

a die defining a first can blank-receiving cavity;

a first punch which is movable between a first punch extended position inside the first cavity and a first punch retracted position outside the first cavity;

a first pair of can blank-gripping first fingers, wherein the first pair is movable longitudinally back and forth in upstream and downstream directions, wherein the first fingers are movable axially inwardly toward one another and the first cavity, and wherein the first fingers are movable axially outwardly away from one another and the first cavity;

an ejector system comprising an ejector which is movable within the first cavity and has an ejecting position and a non-ejecting position, wherein the ejector is adapted to eject a can blank from the first cavity upon movement from the non-ejecting position to the ejecting position; and a first servomotor which is one of (a) operatively connected to the first fingers and configured to drive movement of the first fingers and (b) operatively connected to the ejector and configured to drive movement of the ejector between the ejecting and non-ejecting positions.

2. The press of claim 1 wherein the first servomotor is configured to drive longitudinal movement of the pair of fingers.

3. The press of claim 2 further comprising a second servomotor operatively connected to the fingers and configured to drive axial movement of the fingers.

4. The press of claim 3 further comprising a non-transitory computer program which is in communication with the first and second servomotors, which is programmed to control longitudinal movement of the pair of fingers at a first longitudinal rate over a first longitudinal distance and at a second different longitudinal rate over a second longitudinal distance, and which is programmed to control axial movement of the fingers at a first axial rate over a first axial distance and at a second different axial rate over a second axial distance.

5. The press of claim 4 further comprising a third servomotor operatively connected to the ejector and configured to drive movement of the ejector between the ejecting and non-ejecting positions;

wherein the computer program is in communication with the third servomotor and is programmed to control a rate of movement and travel distance of the ejector.

6. The press of claim 2 further comprising a non-transitory computer program in communication with the first servomotor and programmed to control longitudinal movement of the pair of fingers at a first longitudinal rate over a first longitudinal distance and at a second different longitudinal rate over a second longitudinal distance.

7. The press of claim 1 wherein the first servomotor is configured to drive axial movement of the fingers.

8. The press of claim 7 further comprising a non-transitory computer program in communication with the first servomotor and programmed to control axial movement of the fingers at a first axial rate over a first axial distance and at a second different axial rate over a second axial distance.

9. The press of claim 1 further comprising a non-transitory programmable servomotor control operatively connected to the first servomotor and configured to allow programming which controls the first servomotor to control a rate of movement of the fingers and a travel distance of the fingers.

10. The press of claim 9 wherein the first servomotor is configured to drive longitudinal movement of the pair of fingers; and the programming controls the first servomotor to control a longitudinal rate of movement of the fingers and a longitudinal travel distance of the fingers; and further comprising a second servomotor operatively connected to the fingers and configured to drive axial movement of the fingers;

wherein the programmable servomotor control is operatively connected to the second servomotor and configured to allow programming which controls the second servomotor to control an axial rate of movement of the fingers and an axial travel distance of the fingers.

11. The press of claim 1 wherein the first servomotor is operatively connected to the ejector and configured to drive movement of the ejector between the ejecting and non-ejecting positions.

12. The press of claim 1 further comprising a second can blank-receiving cavity downstream of the first cavity;

a second punch which is movable between a second punch extended position inside the second cavity and a second punch retracted position outside the second cavity;

a second pair of can blank-gripping second fingers, wherein the second pair is movable longitudinally back and forth in the upstream and downstream directions, wherein each of the second fingers is movable axially inwardly toward one another and the second cavity and wherein each of the second fingers is movable outwardly away from one another and the second cavity; and wherein the first servomotor is operatively connected to the second fingers and configured to drive one of (a) longitudinal movement of the second pair of second fingers and (b) axial movement of the second fingers.

13. The press of claim 12 wherein the first cavity has a first diameter and the second cavity has a second diameter which is smaller than the first diameter.

14. The press of claim 1 further comprising a second can blank-receiving cavity downstream of the first cavity;

a second punch which is movable between a second punch extended position inside the second cavity and a second punch retracted position outside the second cavity;

a second pair of can blank-gripping second fingers, wherein the second pair is movable longitudinally back and forth in the upstream and downstream directions, wherein each of the second fingers is movable axially inwardly toward one another and the second cavity and wherein each of the second fingers is movable outwardly away from one another and the second cavity; and a second servomotor operatively connected to the second fingers and configured to drive one of (a) longitudinal movement of the second pair of second fingers and (b) axial movement of the second fingers.

15. The press of claim 14 wherein the first cavity has a first diameter and the second cavity has a second diameter which is smaller than the first diameter.

16. The press of claim 1 further comprising a drive train comprising a crank, a longitudinal slider and an axial slider which carries one of the first fingers; wherein longitudinal movement of the longitudinal slider is translated into axial movement of the axial slider by rotation of the crank.

17. The press of claim 16 wherein the longitudinal slider comprises a longitudinally elongated first rod; and the axial slider comprises a longitudinally elongated second rod which is substantially parallel to the first rod.

18. The press of claim 16 further comprising a first opening formed in one of the longitudinal slider and crank;

a first post secured to the other of the longitudinal slider and crank and received in the first opening;

a second opening formed in one of the axial slider and crank; and a second post secured to the other of the axial slider and crank and received in the second opening.

19. The press of claim 1 wherein the first servomotor has a rotational output; wherein back and forth rotational movement of the rotational output in opposite directions causes back and forth movement of one of (1) the first fingers and (2) the ejector.

20. The press of claim 1 further comprising one or more non-transitory computer programs in communication with the first servomotor and programmed to control movement of the first fingers in accordance with first settings for a first type or size of can blanks and in accordance with different second settings for a different second type or size of can blanks.

21. A redraw press comprising:

a die defining a first can blank-receiving cavity;

a first punch which is movable between a first punch extended position inside the first cavity and a first punch retracted position outside the first cavity;

a first pair of can blank-gripping first fingers, wherein the first pair is movable longitudinally back and forth in upstream and downstream directions, wherein the first fingers are movable axially inwardly toward one another and the first cavity, and wherein the first fingers are movable axially outwardly away from one another and the first cavity; and a drive train comprising a crank, a longitudinal slider and an axial slider which carries one of the first fingers; wherein longitudinal movement of the longitudinal slider is translated into axial movement of the axial slider by rotation of the crank.

22. A method comprising the steps of:

providing a redraw press having first and second die cavities each adapted to receive can blanks, first and second punches respectively movable into and out of the first and second cavities, a pair of can blank-gripping fingers capable of moving a can blank from a first station adjacent the first cavity to a second station adjacent the second cavity, an ejector which is movable within and capable of ejecting can blanks from one of the first and second cavities, and a servomotor; and operating the servomotor to one of (a) move the fingers axially toward one another at a first axial rate over a first axial distance and at a second different axial rate over a second axial distance, (b) move the fingers longitudinally downstream at a first longitudinal rate over a first longitudinal distance and at a second different longitudinal rate over a second longitudinal distance, and (c) move the ejector in an ejecting direction at a first ejecting rate over a first ejecting distance and at a second different ejecting rate over a second ejecting distance.

23. The method of claim 22 further comprising the step of rotating a rotational output of the servomotor back and forth in opposite directions to cause one of (1) axial back and forth movement of the first fingers, (2) longitudinal back and forth movement of the first fingers, and (3) back and forth movement of the ejector.

24. The method of claim 22 wherein the step of providing comprises providing one or more non-transitory computer programs which include first settings and different second settings; and the step of operating comprises operating the servomotor to move at least one of the pair the fingers and the ejector in accordance with the first settings for a first type or size of can blanks and in accordance with the different second settings for a different second type or size of can blanks.

* * * * *